US005767762A

United States Patent [19]

Sako

[11] Patent Number: 5,767,762

[45] Date of Patent: Jun. 16, 1998

[54] OVERCURRENT RELAY HAVING A BIMETAL A RESETTING MEMBER AND AN ACCELERATING MECHANISM

[75] Inventor: Yuji Sako, Nagoya, Japan

[73] Assignees: Mitsubishi Denki Engineering Kabushiki Kaisha; Mitsubishi Denki Kabushiki Kaisha, both of Tokyo, Japan

[21] Appl. No.: 207,746

[22] Filed: Mar. 9, 1994

[30] Foreign Application Priority Data

Mar. 9, 1993 [JP] Japan ..... 5-048056

[51] Int. Cl.[6] ..... H01H 37/70

[52] U.S. Cl. ..... 337/348; 337/333; 337/49; 337/380

[58] Field of Search ..... 337/36, 45–49, 337/121, 333, 337, 348, 380

[56] References Cited

U.S. PATENT DOCUMENTS

| | | | |
|---|---|---|---|
| 4,642,597 | 2/1987 | Sako | 337/82 |
| 4,652,847 | 3/1987 | Sako | 337/49 |
| 4,814,737 | 3/1989 | Ebnet | 337/49 |
| 4,845,455 | 7/1989 | Sako et al. | 337/49 |

FOREIGN PATENT DOCUMENTS

| | | |
|---|---|---|
| 57-185641 | 11/1982 | Japan . |
| 60-62753 | 5/1985 | Japan . |
| 61-75046 | 5/1986 | Japan . |
| 61177330 | 11/1986 | Japan . |
| 62-191148 | 12/1987 | Japan . |
| 2-270244 | 11/1990 | Japan . |

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

An accelerating mechanism in an overcurrent relay for accelerating the speed of moving operation of a resetting bar or the speed of motion in a normally closed contact caused by the resetting bar. In the application of the relay to any resetting mechanism, which effects resetting with a movement of the resetting bar, the relay can eliminate a very hazardous abnormal operation that a resetting operation is stored in a toggle mechanism, thus improving the safety of the resetting mechanism.

10 Claims, 31 Drawing Sheets

OVERCURRENT RELAY HAVING A BIMETAL A RESETTING MEMBER AND AN ACCELERATING MECHANISM

FIELD OF THE INVENTION

This invention relates to an overcurrent relay for protecting a motor or the like against a damage due to overload and, more particularly, to the structure of a contact resetting mechanism for such overcurrent relay.

BACKGROUND OF THE INVENTION

FIGS. 18 to 22 show a conventional thermal overcurrent relay. FIG. 18 is a front view of the relay with a cover 2 thereof removed, FIG. 19 is a plan view of the relay, FIG. 20 is a sectional view taken along line 20—20 in FIG. 18, FIG. 21 is a sectional view taken along line 21—21 in FIG. 18, FIG. 22 is a sectional view taken along line 22—22 in FIG. 18, FIG. 23 is a sectional view taken along line 23—23 in FIG. 19, and FIG. 24 is an exploded perspective view showing a resetting bar and an inverting mechanism in the relay.

Referring to the Figures, designated at 1 is a housing, at 2 a cover, and at 3 bimetals separately provided for each of the operating phases. On each bimetal 3 a heater 4 is wound. When a main circuit current flows through the heater 4, the bimetal 3 is heated to result in curved deformation thereof as shown by dashed line in FIG. 18. The bimetal 3 is supported by a bimetal support 5. The bimetal support 5 has a tongue 5*a*, which is bonded electrically and mechanically by means of welding to the upper end of the bimetal 3. The bimetal support 5 also has a lower portion 5*b* secured by a set screw 6 to the housing 1. Designated at 7 is a load side main circuit terminal. As shown in FIG. 22, it has a shape like letter the L. One end 7*a* of the L shape is screwed in a terminal screw which is connected to the load side main circuit (outer circuit), and the other end 7*b* is bonded electrically and mechanically to the bimetal support 5.

Shown at 9 in FIG. 22 is a power source side main circuit terminal having a substantially channel-like shape. In the top 9*a* of the channel-like terminal 9 is screwed a terminal screw 8 which is connected to the power source side main circuit (outer circuit). The channel-like terminal 9 has a projection 9*b* projecting from its bottom. The upper end 4*a* of the heater 4 is electrically connected by means of welding to the projection 9*b*. The lower end 4*b* of the heater 4 is electrically connected by means of welding to the lower end 3*a* of the bimetal 3.

An interlock member 10 is in contact with the end of each bimetal 3 to transmit a deforming action thereof. As shown in FIG. 18, the left end of the interlock member 10 is adapted to urge the lower end of an ambient temperature compensation bimetal 11. The ambient temperature compensation bimetal 11 has its upper end portion secured to an operating lever 12, which is rotatable about a shaft 13. As shown in FIG. 21, the shaft 13 has its opposite ends supported by a lever support member 14. The lever support member 14 has an L-shaped bend 14*a* in contact with edge 1*a* of the housing 1 so that it is fulcrum supported. It has a first tongue 14*b* urged against an adjustment screw 15.

Its second tongue 14*c* is biased by a leaf spring 16 in the leftward direction in FIG. 18. Thus, by turning an adjustment knob 17 provided a top the adjustment screw 15, the lever support member 14 is rotated about the edge 1*a*. The shaft 13 mounted in the lever support member 14 can undergo position changes substantially in the leftward and rightward directions in FIG. 18, thus effecting operating current control according to the extent of the curving of the bimetals 3 by current in the heaters 4.

Designated at 18 is a movable terminal of a normally closed contact. The terminal 18 is made of a conductive metal sheet. It has its lower edge 18*a* in contact with a first support portion 19*a* of a movable side terminal 19 of the normally closed contact, and is supported for rotation about the portion support 19*a*. An operating member 20 has an edge 20*a* supported in contact with a second support portion 19*b* provided on the normally closed contact movable terminal 19. A tension coil spring 21 is stretched between a hole 20*b* in an upper portion of the operating member 20 and a hole 18*b* formed in a central portion of the normally closed contact movable terminal 18. The operating lever 12 has an L-shaped end 12*a* facing and for being contact with a portion of the operating member 20 substantially a quarter above the edge 20*a* and hole 20*b*. The normally closed contact movable terminal 19 has an outwardly projecting tongue 19*c*, in which a terminal screw 8 connected to an external circuit, not shown, is screwed, and which is secured by a set screw 22 to the housing 1, as shown in FIG. 20.

Designated at 23 in FIG. 23 is a fixed terminal of the normally closed contact. To the terminal 23 is electrically and mechanically coupled by welding, caulking, etc. a normally closed contact fixed terminal 24 made from a conductive and elastic thin metal sheet. A contact 24*a*, which is secured by caulking, welding, etc. to the terminal 24 is likewise disposed such that it faces and can be brought into contact with and separated from a contact 18*c* provided on the normally closed contact movable terminal 18. The above terminals constitute the normally closed contact. The normally closed contact fixed terminal 23 is secured by the set screw 22 to the housing 1, and in its outwardly projecting tongue 23*a* is screwed the terminal screw 8 connected to an external circuit, not shown.

Designated at 25 in FIG. 23 is a movable terminal of a normally open contact. To the terminal 25 is coupled electrically and mechanically by welding, caulking, etc. a normally open contact movable terminal 26 made from a conductive and elastic thin metal plate. The normally open contact movable terminal 25 is secured by the set screw 22 to the housing 1, and in its outwardly projecting tongue 25*a* the terminal screw 8 connected to an external circuit, not shown, is screwed.

Designated at 27 in FIG. 23 is a fixed terminal of the normally open contact. To this terminal 27, a normally open contact fixed terminal 28 made from a conductive and elastic thin metal sheet is coupled electrically and mechanically by welding, caulking, etc. Likewise, a contact 28*a* is secured by caulking, welding, etc. to the normally open contact fixed terminal 28 such that it faces and can be brought into contact with and separated from a contact 26*a* secured to the normally open contact movable terminal 26. The above terminals constitute the normally open contact. The normally open contact fixed terminal 27 is secured by the set screw 22 to the housing 1, and in its outwardly projecting tongue 27*a* is screwed the terminal screw 8 connected to an external circuit, not shown.

As shown in FIG. 20, to the normally closed contact movable terminal 18 is secured by fitting, bonding, etc. an operating lever 29 made of a resin or like insulating material and operable like the normally closed contact movable terminal 18. The operating lever 29 has its lower portion provided with an operating projection 29*a*, which can push the back side 26*b* of the normally open contact movable terminal 26. The operating lever 29 further has its upper portion provided with an arcuate resetting projection 29*b*.

Designated at 30 is a resetting bar, which is guided for movement in vertical directions in FIG. 18 by the housing 1. The resetting bar 30 is biased upward in FIG. 18 by a resetting spring 31 which is a compression coil spring. The resetting bar 30 has a bottom plane stop surface 30*a* facing a resetting projection 29*b* of the operating lever 29. It has a slanted urging surface 30*b* extending above and terminating in the plane stop surface 30*a*. A decorative cover 32 is mounted on top of the housing 1. The top of the cover 32 has a control knob reception hole 32*a*, a resetting bar reception hole 32*b* and an operation display window 32*c*. Further, it has an impression of a scale 32*d* for operating current control. Designated at 33 is a display lever having a central portion 33*a* journalled in the housing. Its lower U-shaped portion 33*a* engages with a clearance with an upper portion of the normally closed contact movable terminal 18. Further, its upper display piece 33*a* can be seen from the outside (i.e., from the top) through the operation display window 32*c* of the cover.

The operation will now be described. Referring to FIG. 22, the main circuit current is caused to flow from the power source side main circuit terminal 9 through each heater 4, each bimetal 3 and each bimetal support member 5 to the load side main circuit terminal 7. To the terminal screw 8, which is screwed in one end 7*a* of the load side main circuit terminal 7, a lead, not shown, is connected. The lead is led to a motor or like load, not shown. Thus, the main circuit current is the same as the load current.

The bimetal 3 is heated and curved as shown by the dashed curve shown in FIG. 18 by the Joule heat generated in the heater 4 and bimetal 3.

When the load is increased to a state of overload, the main circuit current is increased to increase the extent of the curve of the bimetal 3 shown by the dashed curve in FIG. 18. As a consequence, the interlock member 10 are pushed by the end of the bimetal 3 and moved in the leftward direction in FIG. 18. With the movement of the interlock member 10 caused in the leftward direction, the temperature compensation bimetal 11 and operating lever 12, coupled to each other, is pushed and rotated in the clockwise direction by the end of the member 10, causing the L-shaped end 12*a* of the operating lever 12 to push the operating member 20. The operating member 20 is thus rotated about the edge 20*a* in the counterclockwise direction. When the hole 20*b* of the operating member moved to the left and the above rotation crosses a line connecting the hole 18*b* of the normally closed contact movable terminal and the first support portion 19*a* of the normally closed contact movable side terminal, the direction of the biasing force of the tension coil spring 21 exerted to the normally closed contact movable terminal 18 is inverted in direction from the rightward to the leftward direction in FIG. 18. This inversion of the force causes quick inversion of the rotation of the normally closed contact movable terminal 18 about the normally closed contact movable terminal first support portion 19*a* to the counterclockwise direction.

Thus, the contact 18*c* of the normally closed contact movable terminal and the contact 24*a* of the normally closed contact fixed terminal are brought into contact with each other, and the normally closed contact which has been in the state of conduction is opened to cut current. Also, the operating lever 29 secured to the normally closed contact movable terminal 18 is quickly inverted to the counterclockwise direction about the first support portion 19*a* of the normally closed contact movable side terminal, and the operating projection 29*a* of the operating lever pushes the back side 26*b* of the normally open contact movable terminal 26 to cause displacement thereof in the rightward direction in FIG. 23. As a result, the contact 26*a* of the normally open contact movable terminal is brought into contact with the contact 28*a* of the normally open contact fixed side terminal to bring the normally open contact into the state of conduction. The inverse operation of the normally closed contact movable terminal 18 and the operating lever 29 is stopped when the resetting projection 29*b* of the operating lever is brought into contact with the stop surface 30*a* of the resetting bar.

Thus, with the connection of the normally closed switch in series with the operating circuit of the electromagnetic relay, not shown, on-off operating the main circuit current, it is possible to disconnect and protect the main circuit when the motor or like load, not shown, becomes overload. In addition, with an alarm lamp or like circuit connected in series with the normally open contact, it is possible to provide an overload alarm signal.

To reset the normally closed and open contacts after restoration of the bimetal 3 to the initial state with the blocking of the main circuit current, the resetting bar 30 is pushed downward in FIG. 18 by manual operation from the outside. By manually pushing the resetting bar 30 in the downward direction in FIG. 18 against the biasing force of the spring 31, the slant surface 30*b* of the resetting bar pushes the arcuate resetting projection 29*b* of the operating lever. Thus, the operating lever 29 and the normally closed contact movable terminal 18 coupled thereto are rotated in the clockwise direction in FIGS. 18 and 23 about the first support portion 19*a* of the normally closed contact movable side terminal. When the position of the hole 18*b* of the normally closed contact movable terminal rightwardly crosses the line connecting the first and second support portions 19*a* and 19*b* of the normally closed contact movable side terminal, the direction of the biasing force of the tension coil spring 21 exerted to the normally closed contact movable terminal 18 is inverted in direction from the leftward to the rightward direction in FIGS. 18 and 23. Thus, the normally closed contact movable terminal 18 is quickly inverted in direction to the clockwise direction about the first support portion 19*a* of the normally closed contact movable side terminal and reset. In this way resetting to the initial state is obtained, in which the normally closed contact is "on" while the normally open contact is "off".

With the conventional overcurrent relay having the above construction, abnormal operation is liable to occur if the resetting operation is made before the restoration of the bimetal to the initial state. More specifically, when the resetting operation is made with the conventional thermally driven overcurrent relay under the above condition, the normally closed contact movable terminal is stopped in a neutral state (i.e., an intermediate position other than the reset state or the operating state). In this case, the urging pressure of the resetting bar is subsequently removed, and then the bimetal 3 is restored to the initial state. In this case, the abnormal operation of resetting of the normally open contact movable terminal is liable to take place. The abnormal operation is thus prone because the resetting operation is stored in the internal mechanism without operator's intent, and this state is very hazardous.

At this time, the operator thinks that the resetting fails to be effected and interrupts the resetting operation (i.e., discontinues the pushing of the resetting bar). At this time the operator has no sense of storage of the resetting and may carry out the inspection of the motor to shoot the trouble in the overcurrent relay. In this case, the above abnormal resetting operation may occur due to cooling of the bimetal.

In this case, the motor is suddenly started, possibly causing an accident leading to injury or death.

The mechanism causing the above problem will now be described in greater detail with reference to drawing. FIGS. 25 to 28 schematically show the above conventional toggle type inversion mechanism. That is, the Figures schematically show the normally closed contact movable terminal 18, operating member 20, and tension coil spring 21. Referring to FIG. 25, straight line (solid line) G-El corresponds to the normally closed movable terminal 18, and it is rotatable about point G. Straight line (solid line) J1-K represents the operating member 20, and it is rotatable about point K representing the edge 20*a*. Point Ji corresponds to the hole 20*b* of the operating member, and point F1 the hole 18*b* of the normally closed contact movable terminal. The dashed line between the points J1 and F1 corresponds to the tension coil spring. Phantom line G-H1 represents the operating lever 29, and point H1 corresponds to the operating projection 29*a* of the operating lever corresponding to the normally open contact movable terminal 26. The phantom line G-H1 and the phantom line G-E1 are coupled to each other for rotation about the point G. The point G corresponds to the first support portion 19*a* of the normally closed contact movable side terminal, and the point K corresponds to the second support portion 19*b*. Both the points are fixed in position.

FIG. 25 shows the inversion mechanism in operation, i.e., in the tripped state. Arrow R in the Figure represents the direction of movement of the end E1 of the normally closed contact movable terminal caused by the resetting bar. Arrow T, on the other hand, represents the trip direction. The point E1 is moved to the point E2 by the resetting bar. Now, the rotational moment acting on the normally closed contact movable terminal in the trip state thereof shown in FIG. 25 will now be considered. Since the angle between the direction of the tension P1 in the tension coil spring and the line G-F1 is $\beta 1$, denoting the distance of the line segment F1-G by L1, the tension P1 acting on the tension coil spring is a moment of $Q1 \times L1$ and is acting in the direction of arrow T (i.e., trip direction). At this time, there holds a relation $Q1 = P1 \times \sin \beta 1$. Also, denoting the distance of the line segment G-H1 by L2, the force restored by the normally open contact movable terminal as shown by arrow S1, acts as a moment of $S1 \times L2$ in the direction of arrow R (i.e., reset direction) on the normally closed contact movable terminal.

Now, the moment when the point E1 is moved to the point E2 in FIG. 25 when the resetting operation is done, will be considered. It is assumed that the resetting operation is caused in the absence of any restrainment of the point J1, i.e., with the bimetals in the perfectly cooled state. FIG. 26 schematically shows this status. With the displacement of the point E1 to the point E2 caused by the resetting bar, the point F1 is displaced to the point F2, and the point H1 is displaced to the point H2. The point J1, for which there is no restrainment, is displaced to the point J2 on the line connecting the point K and point F2. At this time, the tension P2 in the tension coil spring acts as a moment of $Q2 \times L1$ in the resetting direction. At this time, there holds $Q2 = P2 \times \sin \beta 2$.

With the displacement of the point H1 to the point H2, the warp is reduced to S2. However, the force of the normally open contact movable terminal is acting as a moment of $S2 \times L2$ in the resetting direction. The movement in the operation from the state of FIG. 25 to that of FIG. 26 (i.e., the resetting operation in case when the bimetal is in the cooled state) is shown as a force graph in FIG. 29. In the Figure, the solid plot represents the rotational moment by the tension coil spring, and the phantom plot represents the rotational moment by the force of the normally open contact movable terminal. The dashed plot represents the resultant of these two moments, i.e., a moment received by the normally closed contact movable terminal. When the point E2 is reached, the resultant moment is acting perfectly in the resetting direction and driving the normally closed contact movable terminal in the resetting direction.

In connection with FIG. 25, similar calculation is done in case of the resetting operation caused with the point J1 in the restrained state (i.e., with the bimetals not cooled at all immediately after the tripping). This state of resetting is schematically shown in FIG. 27. In the transition from the state of FIG. 25 to the state of FIG. 27, like the case of FIG. 26, the point F1 is displaced to the point F1, while the point H1 is displaced to the point H2. In this case, however, the operating member is unable to be moved to the right in FIG. 26 but is held stationary because of the restrainment of its end.

Thus, the tension P3 in the tension coil spring acts as a moment of $Q3 \times L1$ in the trip direction. (At this time, there holds a relation $Q3 = P3 \times \sin \beta 3$.) The moment of $S2 \times L2$ acting in the resetting direction as the force of the normally open contact movable terminal, is the same as in the case of FIG. 25. FIG. 30 is a moment force graph in this case. In the Figure the solid plot represents the rotational moment produced by the force of the tension coil spring, the phantom plot represents the rotational moment produced by the force of the normally open contact movable terminal, and the dashed plot represents the resultant moment received by the normally closed contact movable terminal. The resultant moment when the point E2 is reached is acting in the trip direction. Therefore, with discontinuation of the resetting operation, the normally closed contact movable terminal is driven in the trip direction to be reset to the position E1.

Now, the operation will be described in connection with the case when the operating member is restrained in its intermediate position between the states of FIGS. 27 and 26 (i.e., with the bimetals not perfectly cooled). FIG. 28 schematically shows this state. The end of the operating member is restrained such that it can not be displaced rightward from the intermediate point J4 between the points J2 and J1 shown in FIGS. 26 and 29. Thus, the tension P4 in the tension coil spring acts as a moment of $Q4 \times L1$ in the trip direction. (Here, there holds a relation $Q4 = P4 \times \sin \beta 4$. However, the force is very low because $\beta 4$ is small.)

Also, the moment $S2 \times L2$ of the normally open contact movable terminal acting in the resetting direction, is the same as in the case of FIG. 26. FIG. 31 is a force diagram concerning this moment. In the Figure, the solid plot represents the rotational moment provided by the tension coil spring, the phantom line represents the rotational moment provided by the force of the normally open contact movable terminal, and the dashed plot represents the resultant of the two moments, i.e., the moment received by the normally closed contact movable terminal. Shown by the double-dash plot is the frictional force between the lower portion edge of the normally closed contact movable terminal shown in FIG. 18 and the first support portion of the normally closed contact movable side terminal or between the operating projection 29*a* of the operating lever and the normally open contact movable terminal. It acts with a substantially constant value of $+\delta$ or $-\delta$ in the direction of restoring the motion.

The resultant rotational moment (shown by dashed plot) is less than the frictional force at the position E2. Therefore, even by discontinuing the resetting operation the normally closed contact movable terminal remains in the state shown in FIG. 28. When the restrainment of the point J4 is released with the cooling of the bimetals, the reset state of FIG. 26 is brought about. That is, there occurs an abnormal phenomenon that the resetting action fails to be provided when the resetting operation is caused but is brought about independently of the operator's intent as a result of cooling of the bimetals after discontinuation of the resetting operation.

As a cause of the abnormal phenomenon described above, it will be seen from FIG. 31 that with increase of the rotational moment (phantom line) provided by the normally open contact the slope of the resultant moment (dashed plot) is reduced to extend the range of J4 remaining under the influence of the frictional force. Heretofore, efforts have been paid to alleviate the abnormal phenomenon, such as by reducing the force provided by the normally open contact or increasing the slope of the rotational moment provided by the tension coil spring by increasing the force thereof. In addition, efforts have been made for reducing the frictional force. However, the results obtained by the efforts are all alleviation of the phenomenon instead of elimination thereof.

SUMMARY OF THE INVENTION

The invention seeks to solve the above problems, and its object is to provide an overcurrent relay, which is applicable to any resetting mechanism for effecting resetting with a resetting bar moving operation and eliminates the very hazardous abnormal operation of storing the resetting operation in a toggle mechanism, thus improving the safety.

According to the invention, there is provided an overcurrent relay, which comprises a bimetal capable of being curved in response to a current caused therein, an inverting mechanism, a toggle mechanism for transmitting a motion of the bimetal to the inverting mechanism, a normally closed or open contact, interlock means for operating the normally closed or open contact in an operation interlocked to the motion of the bimetal, an operating member for moving the normally closed or open contact or a part coupled thereto in the opposite direction to the direction of the interlocked operation, and an accelerating mechanism for accelerating the speed of operation of moving the operating member or the speed of motion of the normally closed or open contact caused by the operating member.

The normally closed contact is opened at its position corresponding to a dead point of resetting of the toggle mechanism.

The accelerating mechanism has a slant surface formed on the operating member for urging the normally closed or open contact or a part coupled thereto, the slant surface having a step.

The accelerating mechanism can reset the normally closed or open contact by causing the operating member to push, pull, turn or otherwise move the normally closed or open contact or the part coupled thereto, the operating member having a guiding portion for generating an engagement in the operation in the moving direction during the moving operation, the operating member also having an engagement portion for the engagement.

The accelerating mechanism includes a toggle type leaf or wire spring provided on the operating member, the leaf or spring wire causing an acceleration of the operating member with a speed thereof.

The operating member and the leaf or wire spring are integral with each other.

The accelerating mechanism includes an elastically deformable portion provided on the operating member and utilizes inertia when the elastically deformable portion clears an intermediate engagement portion provided on a guiding member for guiding the operating member.

The accelerating mechanism effects resetting with a rotational motion of the operating member, the operating member or a guiding portion of the operating member being provided with an engagement portion, the operating member having an elastically deformable, manually operable portion.

According to the invention, the step provided on the slant surface of the resetting bar permits a quick action of the normally closed or open contact engaged by it to be obtained even by slowly pushing the resetting bar. In addition, an overrun is produced to the extent of movement of the normally closed or open contact being pushed.

Further, a guiding portion is provided in addition to a projection provided on the resetting bar such as to cause an engagement during the operation of pushing the resetting bar. Thus, even with slow pushing operation of the resetting bar, quick operation thereof can be obtained subsequent to the engagement. Thus, quick motion and overrun of the normally closed or open contact can be obtained by pushing the contact.

As has been described in the foregoing, according to the invention in an overcurrent relay comprising a bimetal capable of being curved in response to a current caused therein, an inverting mechanism, a toggle mechanism for transmitting a motion of the bimetal to the inverting mechanism, a normally closed or open contact, interlock means for operating the normally closed or open contact in an interlocked operation to the motion of the bimetal, and an operating member for moving the normally closed or open contact or a part coupled thereto in the opposite direction to the direction of the interlock operation, an accelerating mechanism is provided for accelerating the speed of operation of moving the operating member or the speed of motion of the normally closed or open contact caused by the operating member. Thus, the invention is applicable to all resetting mechanisms, in which a resetting bar is moved for resetting, for eliminating the very hazardous abnormal operation that the resetting operation is stored in the toggle mechanism and thus improving the safety.

In the accelerating mechanism according to the second embodiment, in addition to the effect according to the first invention (namely, a dangerous and abnormal operation that the reset operation is stored in the toggle mechanism is excluded), an inclined surface for pressing is formed in the operating section, a permanently closed contact, a permanently open contact, or coupling parts for them is pressed by said inclined surface, and a step is provided in the slope, so that engagement occurs only when the operating member (reset bar) is pressing and does not occur when the operating member (reset bar) is restored to the original position by a return spring, and for this reason, it is possible to provide a highly reliable mechanism eliminating malfunctions such as return fault of the operating member (reset bar). Also the state of hooking when the operating member (reset bar) can freely be designed by adjusting an angle of the slope or a height of the step, so that it is possible to obtain a mechanism giving the best feeling in the reset operation.

In the accelerating mechanism according to the third embodiment, a permanently closed contact, a permanently open contact, or coupling parts for them are pressed, pulled, or rotated by the operating member to reset said permanently closed contact or said permanently open contact, and also a section for engagement is provided in a member guiding said operating member so that hooking is generated during movement of said operating member in the direction of movement thereof as well as in said operating member respectively, and for this reason it is possible to achieve the effect realized by the first embodiment only by forming a section for engagement (convex or concave sections) in the conventional components without adding new parts, namely without raising the price of the product. Also, a space for engagement in each section for engagement is decided according to a simple hole dimension or a simple bore dimension in the guide member and the operating member, so that adjustment of the hooking condition and management when produced in mass are quite easy, and as a result a cheap cost can be provided with the minimum cost required for adjustment of the operating forces.

In the accelerating mechanism according to the fourth embodiment, a plate spring or a linear spring based on a toggle system is provided in the operating member, and a speed of said operating member itself is accelerated by said plate spring or said linear spring during movement thereof, and engagement or hooking is not used, so that deterioration in the performance of the accelerating mechanism due to frictions between the hooking sections and the sections for engagement does not occur and a mechanism having a long service life can be provided.

With the fifth embodiment, the plate spring or the linear spring according to the fourth embodiment are formed integrally with the operating member and the spring portion is formed with resin, so that friction between the plate spring or the linear spring and the operating members and furthermore friction between the plate spring or the linear spring and the case are eliminated. For this reason, it is possible to provide a mechanism having a longer service life as compared to that of a mechanism according to the fourth embodiment. Also by forming the spring monolithically with the operating member, the cost required for assembly can be reduced, and for this reason it is obvious that an extremely cheap mechanism can be provided.

In the acceleration mechanism according to the sixth embodiment, an elastically deforming section is provided in the operating member, and inertia generated when said elastically deforming section goes over a section for engagement provided in a portion for guiding said operating member is utilized, so that an operating force (a force for reset operation) of the operating member required to disconnect the engagement can be reduced to a smaller one as compared to that required when the section for engagement does not deform elastically, and also it is possible to design said operating force at an optimal level by adjusting the deforming force of the elastically deforming section, in other words by changing such parameters as a thickness of the elastically deforming section, which in turn makes it possible to realize a mechanism giving an excellent feeling in operation.

In the accelerating mechanism according to the seventh embodiment, the operating member executes resetting according to a revolving movement thereof, a section for engagement is provided in said operating member or in the portion for guiding said operating member, and in addition the manually operated section of said operating member elastically deforms, so that uncomfortable feeling caused by hooking when the operating member is engaged such as that occurring in a mechanism in which the manually operated section does not elastically deform can be eliminated. Also when the manually operated section deforms to a point where the frictional force of the engagement section is overcome, the force caused by this deformation is released, so that a speed of the operating member after the operating member goes over the engagement section is stabilized at a constant level irrespective of the speed of manual operation, and for this reason it is possible to obtain an extremely stable performance for reset operation (the capability to exclude the possibility of a dangerous and abnormal operation that the reset operation is kept in the toggle mechanism).

Other objects and features of this invention will become understood from the following description with reference to the accompanying drawings.

DETAILED DESCRIPTION OF THE EMBODIMENTS

Figure 1:
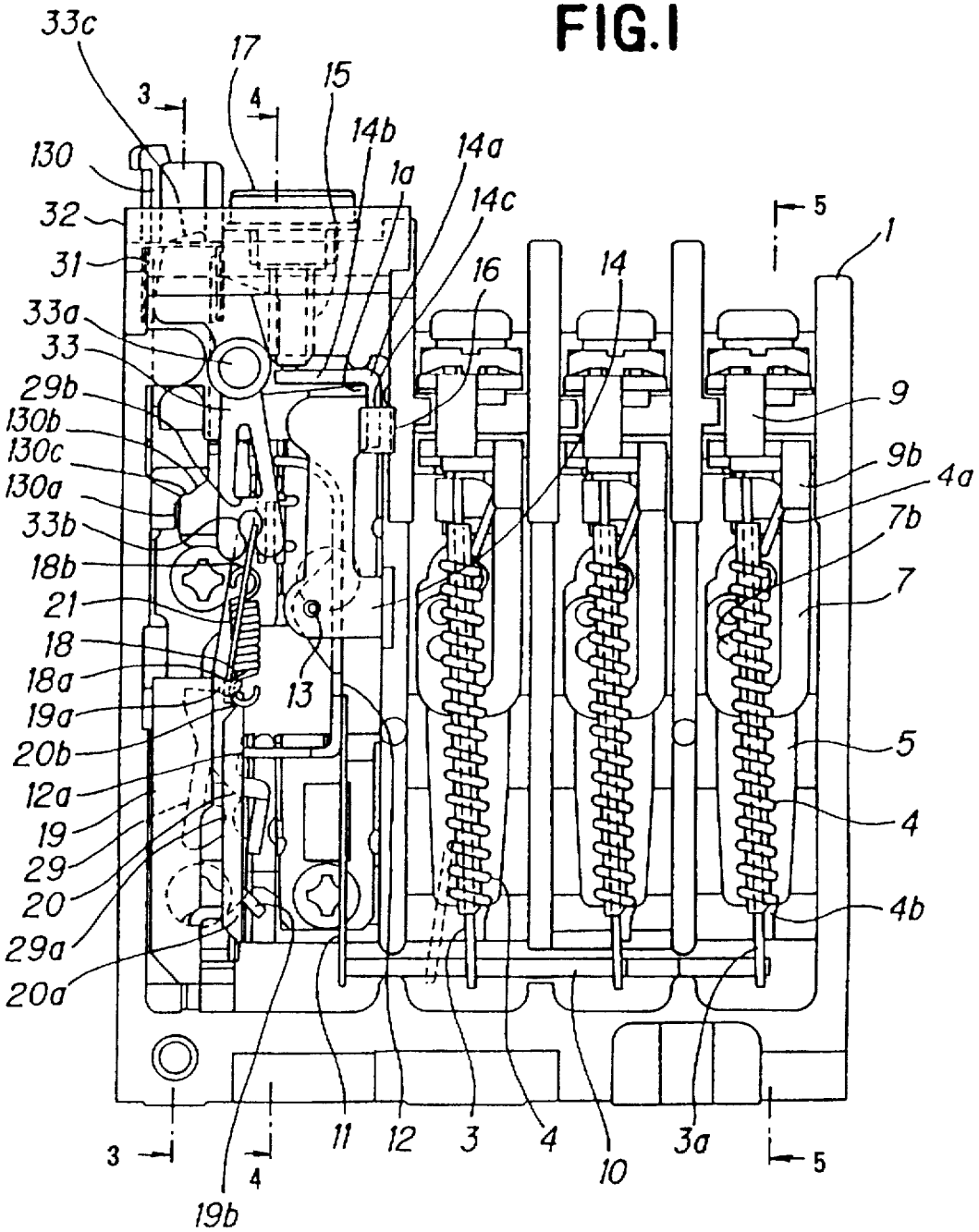
FIG. 1 is a front view showing an overcurrent relay according to the invention with a cover removed.
Figure 2:
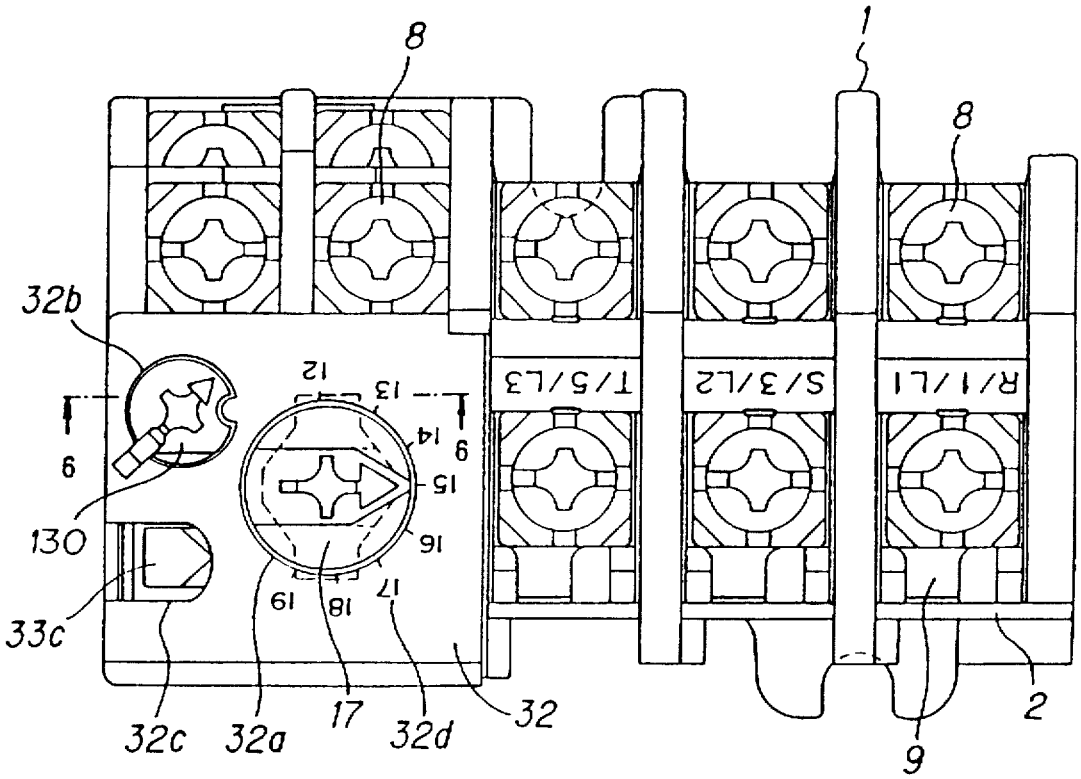
FIG. 2 is a plan view showing the overcurrent relay shown in FIG. 1.
Figure 3:
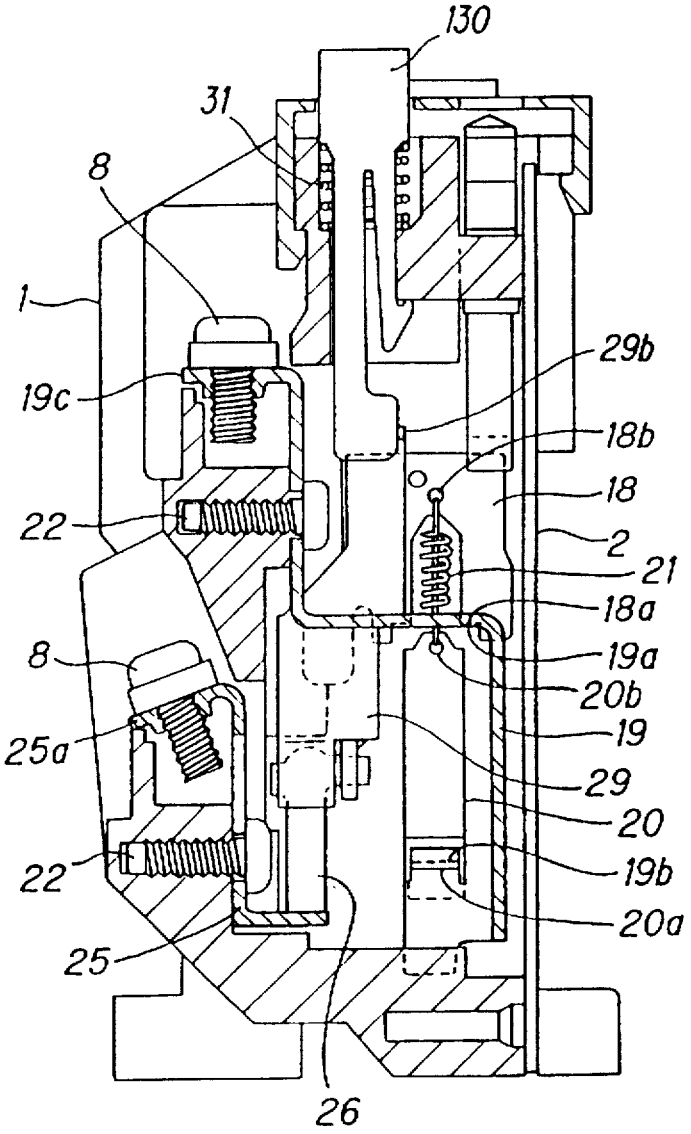
FIG. 3 is a sectional view taken along line 3—3 in FIG. 1.
Figure 4:
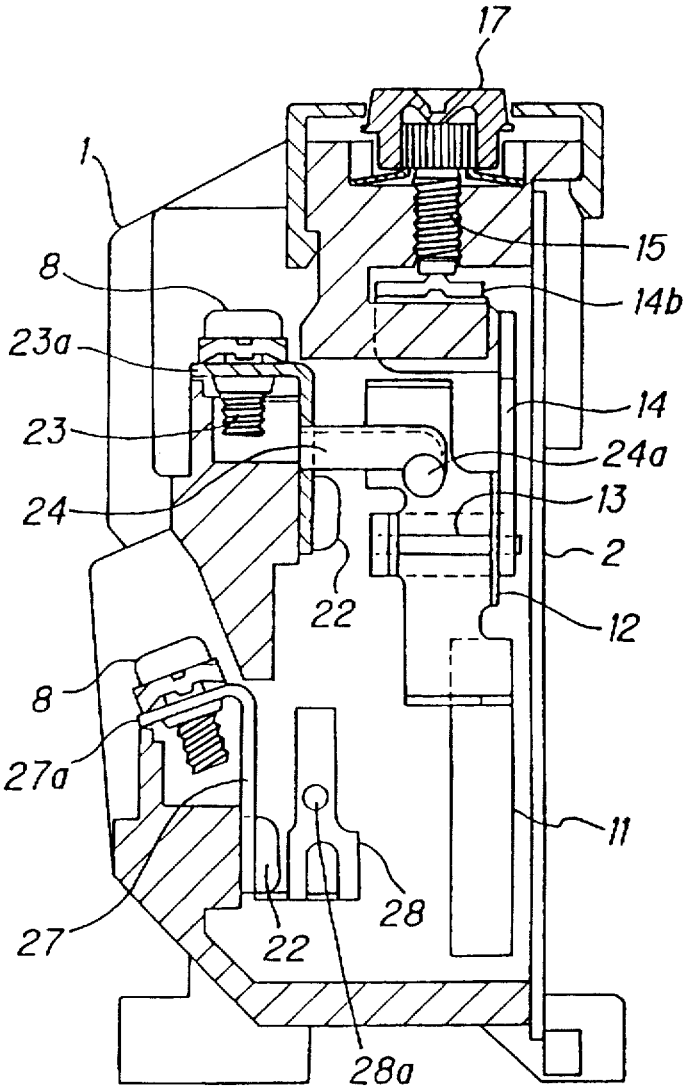
FIG. 4 is a sectional view taken along line 4—4 in FIG. 1.
Figure 6:
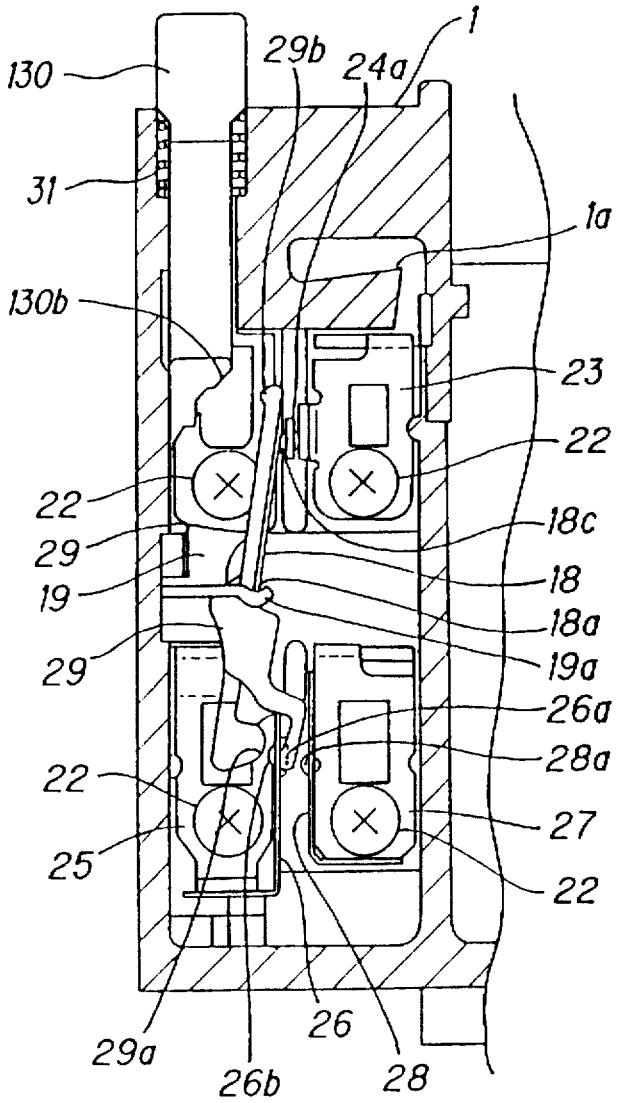
FIG. 6 is a sectional view taken along line 6—6 in FIG. 2.
Figure 7:
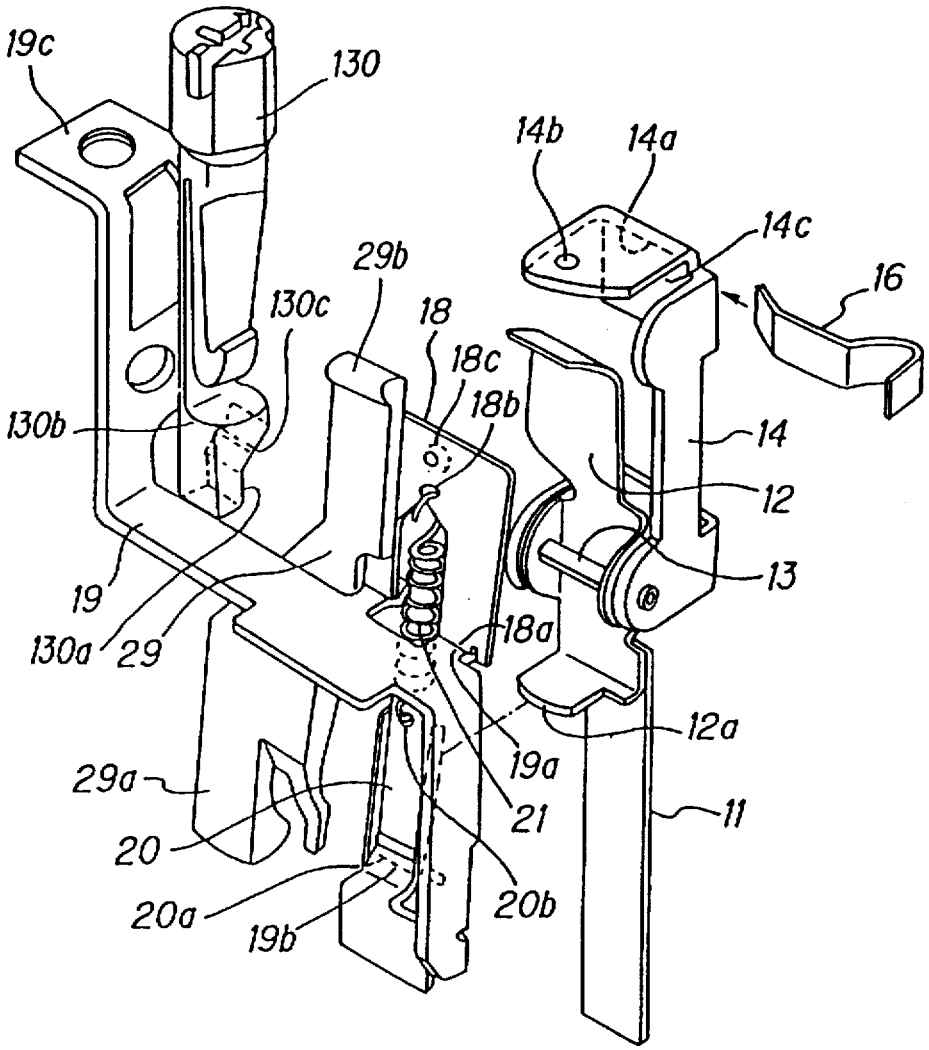
FIG. 7 is an exploded perspective view showing an essential part of a resetting bar and an inversion mechanism in the overcurrent relay according to the invention.

Now, a first embodiment of the invention will be described with reference to FIGS. 1 to 7. FIG. 1 is a front view of the relay with a cover 2 thereof removed, FIG. 2 is a plan view of the relay, FIG. 3 is a sectional view taken along line 3—3 in FIG. 1, FIG. 4 is a sectional view taken along line 4—4 in FIG. 1, FIG. 5 is a sectional view taken along line 5—5 in FIG. 1, FIG. 6 is a sectional view taken along line 6—6 in FIG. 1, and FIG. 7 is an exploded perspective view showing a resetting bar and an inverting mechanism in the relay.

Referring to the Figures, designated at 1 is a housing, at 2 a cover, and at 3 bimetals each provided for each phase. On each bimetal 3 a heater 4 is wound. When a main circuit current flows through the heater 4, the bimetal 3 is heated to result in curved deformation thereof as shown by a dashed line in FIG. 1. The bimetal 3 is supported by a bimetal support 5. The bimetal support 5 has a tongue 5*a*, which is bonded electrically and mechanically by means of welding to the upper end of the bimetal 3. The bimetal support 5 also has a lower portion 5*b* secured by a set screw 6 to the housing 1. Designated at 7 is a load side main circuit terminal. As shown in FIG. 5, it has a shape like the letter L. One end 7*a* of the L shape is screwed in a terminal screw which is connected to the load side main circuit (outer circuit), and the other end 7*b* is bonded electrically and mechanically to the bimetal support 5.

Figure 5:
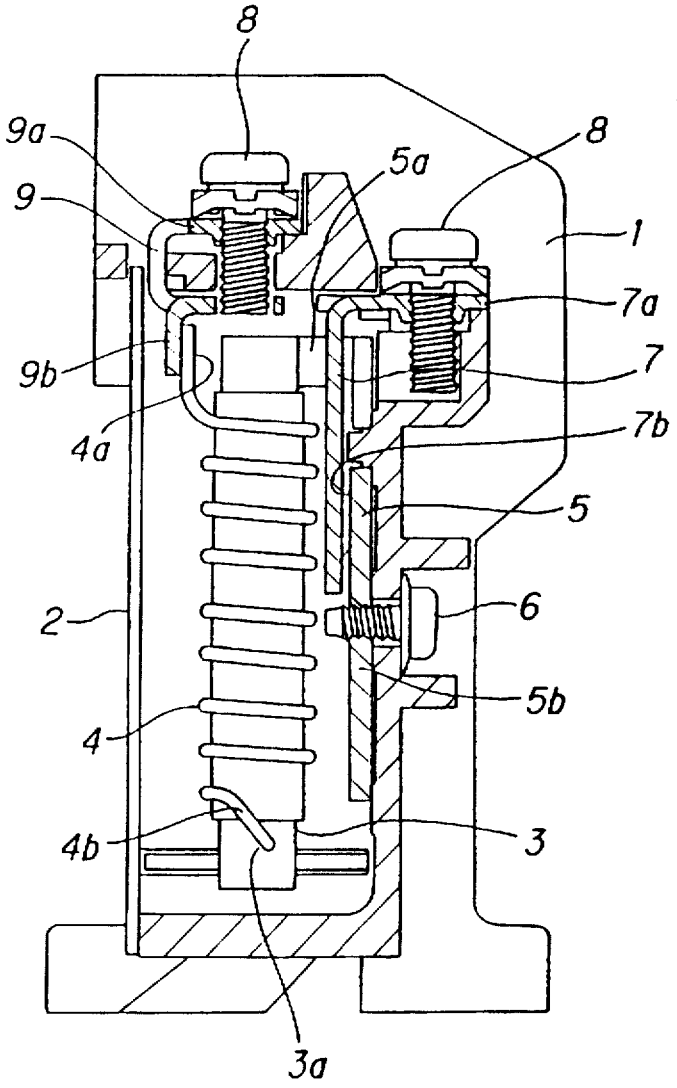
FIG. 5 is a sectional view taken along line 5—5 in FIG. 1.

Shown at 9 in FIG. 5 is a power source side main circuit terminal having a substantially channel-like shape. In the top 9*a* of the channel-like terminal 9 is screwed a terminal screw 8 which is connected to the power source side main circuit (outer circuit). The channel-like terminal 9 has a projection 9*b* projecting from its bottom. The upper end 4*a* of the heater 4 is electrically connected by means of welding to the projection 9*b*. The lower end 4*b* of the heater 4 is electrically connected by means of welding to the lower end 3*a* of the bimetal 3.

An interlock member 10 is in contact with the end of each bimetal 3 to transmit a deforming action thereof. As shown in FIG. 1, the left end of the interlock member 10 is adapted to urge the lower end of a temperature compensation bimetal 11. The temperature compensation bimetal 11 has its upper end portion secured to an operating lever 12, which is rotatable about a shaft 13. As shown in FIG. 4, the shaft 13 has its opposite ends supported by a lever support member 14. The lever support member 14 has an L-shaped bend 14*a* in contact with edge 1*a* of the housing 1 so that it is fulcrum supported. It has a first tongue 14*b* urged against an adjustment screw 15.

Its second tongue 14*c* is biased by a leaf spring 16 in the leftward direction in FIG. 1. Thus, by turning an adjustment knob 17 provided atop the adjustment screw 15, the lever support member 14 is rotated about the edge 1*a*. The shaft 13 mounted in the lever support member 14 can undergo position changes substantially in the leftward and rightward directions in FIG. 1, thus effecting operating current control according to the extent of curving of the bimetals 3 curved by current in the heaters 4.

Designated at 18 is a movable terminal of a normally closed contact. The terminal 18 is made of a conductive metal sheet. It has its lower edge 18*a* in contact with a first support portion 19*a* of a movable side terminal 19 of the normally closed contact, and is supported for rotation about the portion support 19*a*. An operating member 20 has an edge 20*a* supported in contact with a second support portion 19*b* provided on the normally closed contact movable terminal 19. A tension coil spring 21 is stretched between a hole 20*b* in an upper portion of the operating member 20 and a hole 18*b* formed in a central portion of the normally closed contact movable terminal 18. The operating lever 12 has an L-shaped end 12*a* facing and for being contact with a portion of the operating member 20 substantially a quarter above the edge 20*a* and hole 20*b*. The normally closed contact movable terminal 19 has an outwardly projecting tongue 19*c*, in which a terminal screw 8 connected to an external circuit, not shown, is screwed, and which is secured by a set screw 22 to the housing 1, as shown in FIG. 3.

Designated at 23 in FIG. 6 is a fixed terminal of the normally closed contact. To the terminal 23 is electrically and mechanically coupled by welding, caulking, etc. a normally closed contact fixed terminal 24 made from a conductive and elastic thin metal sheet. A contact 24*a*, which is secured by caulking, welding, etc. to the terminal 24 is likewise disposed such that it faces and can be brought into contact with and separated from a contact 18*c* provided on the normally closed contact movable terminal 18. The above terminals constitute the normally closed contact. The normally closed contact fixed terminal 23 is secured by the set screw 22 to the housing 1, and in its outwardly projecting tongue 23*a* is screwed the terminal screw 8 connected to an external circuit, not shown.

Designated at 25 in FIG. 6 is a movable terminal of a normally open contact. To the terminal 25 is coupled electrically and mechanically by welding, caulking, etc. a normally open contact movable terminal 26 made from a conductive and elastic thin metal plate. The normally open contact movable terminal 25 is secured by the set screw 22 to the housing 1, and in its outwardly projecting tongue 25*a* the terminal screw 8 connected to an external circuit, not shown, is screwed.

Designated at 27 in FIG. 6 is a fixed terminal of the normally open contact. To this terminal 27, a normally open contact fixed terminal 28 made from a conductive and elastic thin metal sheet is coupled electrically and mechanically by welding, caulking, etc. Likewise, a contact 28*a* is secured by caulking, welding, etc. to the normally open contact fixed terminal 28 such that it faces and can be brought into contact with and separated from a contact 26*a* secured to the normally open contact movable terminal 26. The above terminals constitute the normally open contact. The normally open contact fixed terminal 27 is secured by the set screw 22 to the housing 1, and in its outwardly projecting tongue 27*a* is screwed the terminal screw 8 connected to an external circuit, not shown.

As shown in FIG. 3, to the normally closed contact movable terminal 18 is secured by fitting, bonding, etc. an operating lever 29 made of a resin or like insulating material and operable like the normally closed contact movable terminal 18. The operating lever 29 has its lower portion provided with an operating projection 26*a*, which can push the back side 26*b* of the normally open contact movable terminal 26. The operating lever 29 further has its upper portion provided with an arcuate resetting projection 29*b*.

Designated at 130 is a resetting bar, which is guided for movement in vertical directions in FIG. 1 by the housing 1. The resetting bar 130 is biased upward in FIG. 1 by a resetting spring 131 which is a compression coil spring. The resetting bar 130 has a bottom plane stop surface 130*a* facing a resetting projection 29*b* of the operating lever 29. It has a slanted urging surface 130*b* extending above and terminating in the plane stop surface 130*a*.

A decorative cover 32 is mounted on top of the housing 1. The top of the cover 32 has a control knob reception hole 132*a*, a resetting bar reception hole 32*b* and an operation display window 32*c*. Further, it has an impression of a scale 32*d* for operating current control. Designated at 33 is a display lever having a central portion 33*a* journalled in the housing. Its lower U-shaped portion 33*a* engages with a clearance with an upper portion of the normally closed contact movable terminal 18. Further, its upper display piece 133*a* can be seen from the outside (i.e., from the top) through the operation display window 32*c* of the cover.

The operation will now be described. Referring to FIG. 5, the main circuit current is caused to flow from the power source side main circuit terminal 9 through each heater 4, each bimetal 3 and each bimetal support member 5 to the load side main circuit terminal 7. To the terminal screw 8, which is screwed in one end 7*a* of the load side main circuit terminal 7, a lead, not shown, is connected. The lead is led to a motor or like load, not shown. Thus, the main circuit current is the same as the load current.

Figure 8:
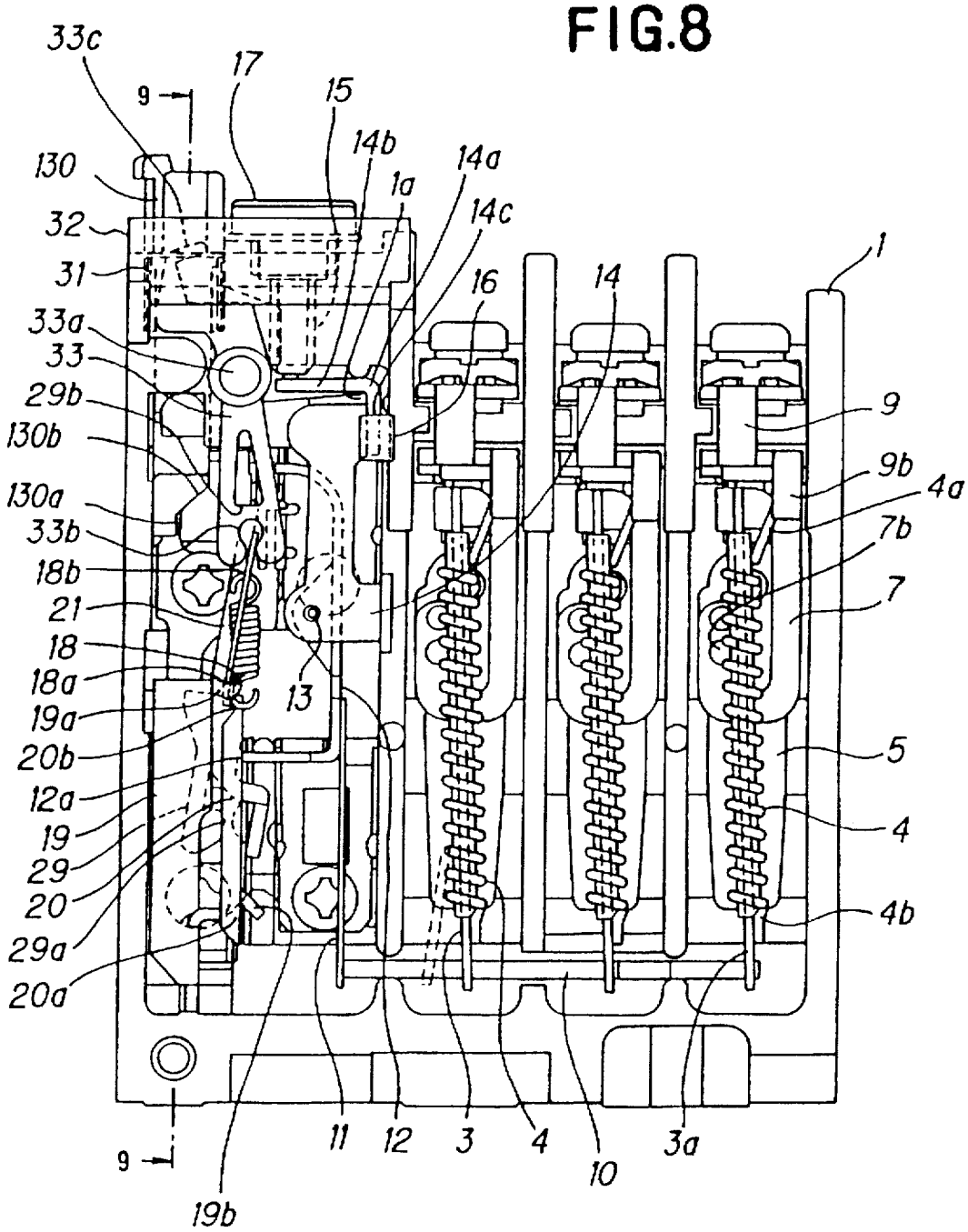
FIG. 8 is a front view showing another overcurrent relay embodiment according to the invention with a cover removed.

The bimetal 3 is heated and curved as shown by the dashed curve shown in FIG. 8 by the Joule heat generated in the heater 4 and bimetal 3.

When the load is increased to a state of overload, the main circuit current is increased to increase the extent of the curve of the bimetal 3 shown by the dashed curve in FIG. 1. As a consequence, the interlock member 10 is pushed by the end of the bimetal 3 and moved in the leftward direction in FIG. 1. With the movement of the interlock member 10 caused in the leftward direction, the temperature compensation bimetal 11 and operating lever 12, coupled to each other, is pushed and rotated in the clockwise direction by the end of the member 10, causing the L-shaped end 12*a* of the operating lever 12 to push the operating member 20. The operating member 20 is thus rotated about the edge 20*a* in the counterclockwise direction. When the hole 20*b* of the operating member moved to the left with the above rotation crosses a line connecting the hole 18*b* of the normally closed contact movable terminal and the first support portion 19*a* of the normally closed contact movable side terminal, the direction of the biasing force of the tensile coil spring 21 exerted to the normally closed contact movable terminal 18 is inverted in direction from the rightward to the leftward direction in FIG. 1. This inversion of the force causes quick inversion of the rotation of the normally closed contact movable terminal 18 about the normally closed contact movable terminal first support portion 19*a* in the counterclockwise direction.

Thus, the contact 18*c* of the normally closed contact movable terminal and the contact 24*a* of the normally closed contact fixed terminal are brought into contact with each other, and the normally closed contact which has been in the state of conduction is opened to cut current. Also, the operating lever 29 secured to the normally closed contact movable terminal 18 is quickly inverted to the counterclockwise direction about the first support portion 19*a* of the normally closed contact movable side terminal, and the operating projection 29*a* of the operating lever pushes the back side 26*b* of the normally open contact movable terminal 26 to cause displacement thereof in the rightward direction in FIG. 6. As a result, the movable contact 26*a* is brought into contact with the fixed contact 28*a*. The inverse operation of the normally closed contact movable terminal 18 and the operating lever 29 is stopped when the resetting projection 29*b* of the operating lever is brought into contact with the stop surface 30*a* of the resetting bar.

Thus, with the connection of the normally closed switch in series with the operating circuit of the electromagnetic relay, not shown, on-off operating the main circuit current, it is possible to disconnect and protect the main circuit when the motor or like load, not shown, becomes overloaded. In addition, with an alarm lamp or like circuit connected in series with the normally open contact, it is possible to provide an overload alarm signal.

To reset the normally closed and open contacts after restoration of the bimetal 3 to the initial state with the blocking of the main circuit current, the resetting bar 130 is pushed downward in FIG. 1 by manual operation from the outside. By manually pushing the resetting bar 130 in the downward direction in FIG. 1 against the biasing force of the spring 31, the slant surface 130*b* of the resetting bar pushes the arcuate resetting projection 29*b* of the operating lever. Thus, the operating lever 29 and the normally closed contact variable contact 18 coupled thereto are rotated in the clockwise direction in FIGS. 1 and 6 about the first support portion 19*a* of the normally closed contact variable side terminal.

When the resetting bar is pushed until the arcuate resetting projection 29*b* of the operating lever is brought into engagement with the step 130*c* provided on the slant surface 130*b* at an intermediate position thereof, a transient engagement is produced with respect to the pushing operation. However, by further pushing the resetting lever against an engagement, the operating lever 29 and the normally closed contact movable terminal 18 coupled thereto are quickly rotated about the support portion 19*a* in the clockwise direction in FIG. 1 with their inertia which is sufficient for the resetting projection 29*b* to clear the step 130*c*. The extent of this clockwise rotation is greater than the extent of rotation in the case of absence of the step 130*c* as in the conventional system owing to an overrun based on the inertia. Thus, the hole 18*b* of the normally closed contact movable terminal crosses the line connecting the second and first support portions 19*b* and 19*a* of the normally closed contact movable side terminal, thus causing inversion of the direction of the biasing force of the tension coil spring 21 applied to the normally closed contact movable terminal 18 from the leftward to the rightward direction in FIGS. 1 and 6. The normally closed contact movable terminal 18 is thus quickly inverted in its rotation about the first support portion 19*a* of the normally closed contact movable terminal to the clockwise direction and reset. Thus, the normally closed contact is turned on while the normally open contact is turned off, and the initial state is thus restored.

In this resetting operation, the operation of the operating lever 29 and the normally closed contact movable terminal 18 coupled thereto, is also brought about when the resetting bar 130 is pushed downward while the bimetals 3 have not been restored. Thus, even under a condition, under which the normally closed contact movable terminal 18 in the conventional system would be stopped at the neutral position, the resetting can be effected with the neutral position cleared owing to the above operation of quick rotation and the overrun. It is thus possible to eliminate the abnormal phenomenon of storing the resetting operation with the inversion mechanism.

Now, another embodiment of the invention will be described with reference to FIGS. 8 and 9. FIG. 8 is a front view of the embodiment with the cover 2 removed, and FIG. 9 is a sectional view taken along line 9—9 in FIG. 8.

Figure 9:
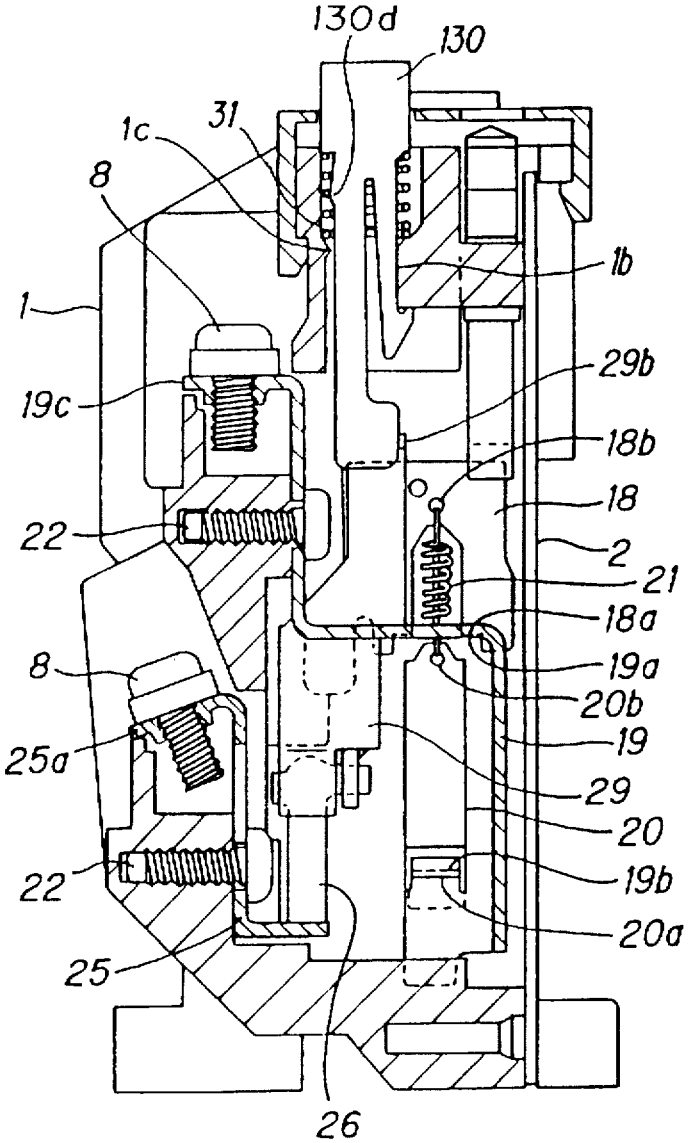
FIG. 9 is a sectional view taken along line 9—9 in FIG. 8.

Designated at 130 is a resetting bar, which is guided for its movement by the guide hole 1*b* in the housing 1 in vertical directions in FIGS. 8 and 9. The resetting bar 130 is also biased upward in FIG. 1 by the return spring 31 which is a compression coil spring. It has a plane stop surface 130*a* at its bottom such as to face the resetting projection 29*b* of the operating lever 29. Above the stop plane 130*a* the slant surface 130*b* is provided such as to be terminated in the stop surface 130*a*.

As shown in FIG. 9, the surface of the guide hole 1*b* is provided with a guide protuberance 1*c*, which is adapted to be faced by a protuberance 130*d* of the resetting bar 130. For the remainder the structure is substantially the same as the previous embodiment.

In this embodiment, like the first embodiment, the resetting operation is caused by manually pushing the resetting lever 130 downward in FIG. 1 from the outside. As the resetting lever 130 is manually pushed downward in FIGS. 8 and 9 against the biasing force of the biasing spring 31, the arcuate resetting projection 29*b* of the operating lever is pushed by the slant surface 130*b* of the resetting bar, and thus the operating lever 29 and the normally closed contact movable terminal 18 coupled thereto are rotated about the first support portion 19*a* of the normally closed contact movable terminal in the counterclockwise direction.

When the resetting bar is pushed until its protuberance 130*d* strikes the guide hole protuberance 1*c*, a transient engagement is brought about against the urging operation. However, by continually pushing the resetting bar 130, it is quickly lowered with the inertia sufficient for its protuberance 130*d* to clear the guide hole protuberance 1*c*. With this quick motion of the resetting lever, rotation of the operating lever 29 pushed by the slant surface 130*b* and the normally closed contact movable terminal 18 coupled to the lever 29 is caused to a greater extent than in the case of absence of the guide hole protuberance 1*c* and resetting bar protuberance 130*c* owing to the inertia and overrun noted above.

Thus, the hole 18*b* of the normally closed contact movable terminal rightwardly crosses the line connecting the second and first support portions 19*b* and 19*a* of the normally closed contact movable terminal, thus causing inversion of the direction of the biasing force of the tension coil spring 21 applied to the normally closed contact movable terminal 18 from the leftward to the rightward direction in FIG. 8. Thus, the normally closed contact movable terminal 18 is quickly inverted in its rotation about the first support portion 19*a* of the normally closed contact movable terminal to the clockwise direction and reset. Thus, the normally closed contact is turned on while the normally open contact is turned off. The initial state is thus restored.

The operating lever 29 and the normally closed contact movable terminal 18 behave in the same way when the resetting bar 130 is pushed downward in the resetting operation with the bimetals 3 not in the restored state. Thus, even under the condition, under which the normally closed contact movable terminal 18 in the conventional system would be stopped at the neutral position, the resetting can be effected with the neutral point cleared with the above quick rotation and great extent of rotation owing to the overrun. It is thus possible to eliminate the generation of the abnormal phenomenon that the resetting operation is stored by the inversion mechanism.

In the second embodiment shown in FIGS. 8 and 9, use is made of the slant surface 130*b* for the resetting. This resetting system, however, is by no means limitative. For example, it is possible to use a resetting bar, which is elongate horizontally for sliding to the left and right in FIG. 8 to push or pull the normally closed contact mechanism element. Again in this case, the resetting bar and the guide portion are provided with engagement protuberances. With this arrangement, similar effects are obtainable. Further, it is possible to use a resetting bar, which undergoes rotational motion instead of the translational motion, while providing protuberances like those noted above. Again with this arrangement similar effects are obtainable.

In the first embodiment of the invention shown in FIGS. 1 to 7 and the second embodiment shown in FIGS. 8 and 9, the resetting bar is adapted to cause movement of the normally closed contact for resetting. However, it is possible to apply the first and second embodiments with similar effects to a resetting mechanism, in which the resetting bar causes movement of the normally open contact or both the normally closed and open contacts.

Figure 10:
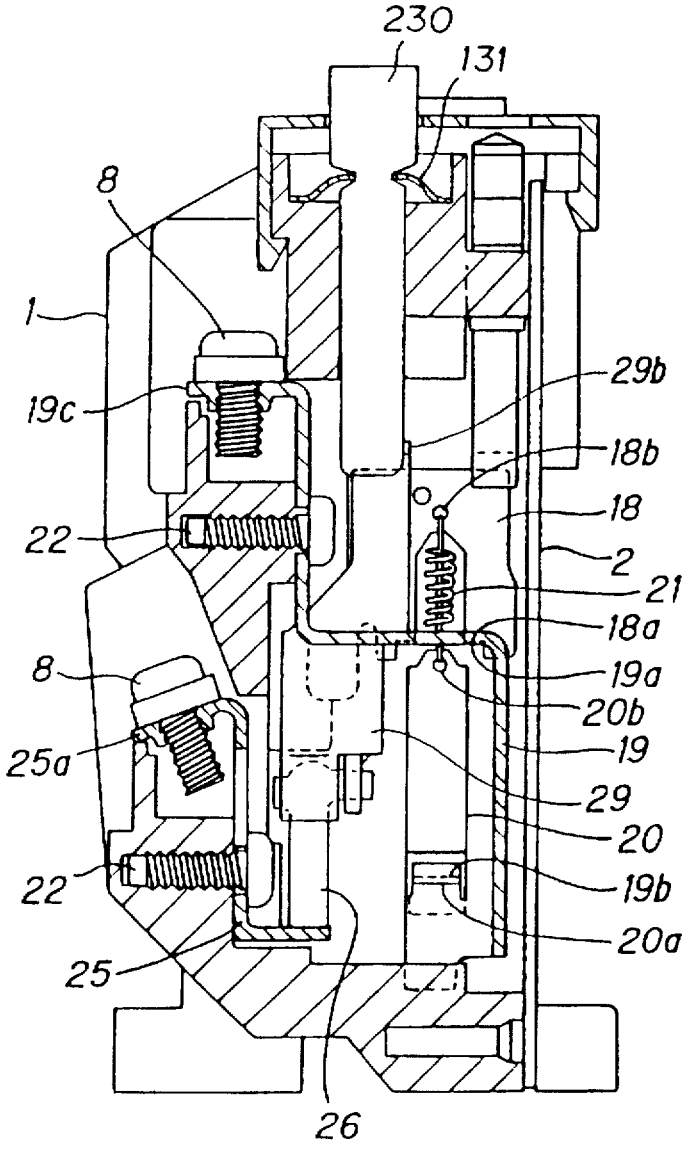
FIG. 10 is a sectional view showing a further overcurrent relay embodiment according to the invention.
Figure 11:
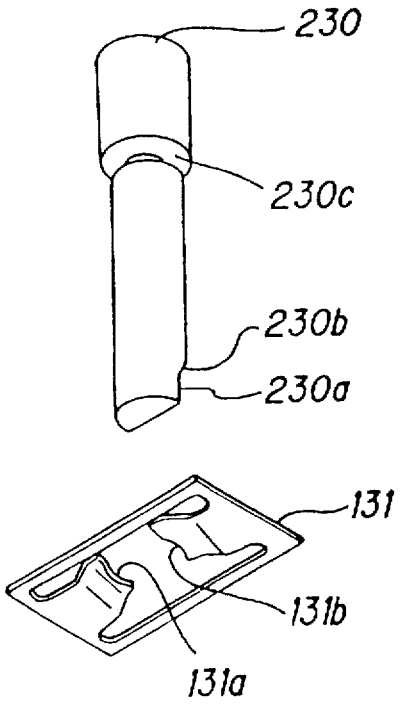
FIG. 11 is a view for explaining the arrangement of a resetting bar and a leaf spring shown in FIG. 10.

A third embodiment of the invention will now be described with reference to FIGS. 10 and 11. Like the first embodiment, a resetting bar 230 has a stop surface 230*a* and a slant surface 230*b*. In this instance, however, a leaf spring 131 is assembled in a neck bottom 230*c*. The leaf spring 131 has spring portions 131*a* and 131*b*, which constitute a toggle mechanism together with the neck bottom 230*c*. By pushing the resetting bar 230, it is quickly lowered from a point, at which the dead point of the toggle is cleared.

Figure 12:
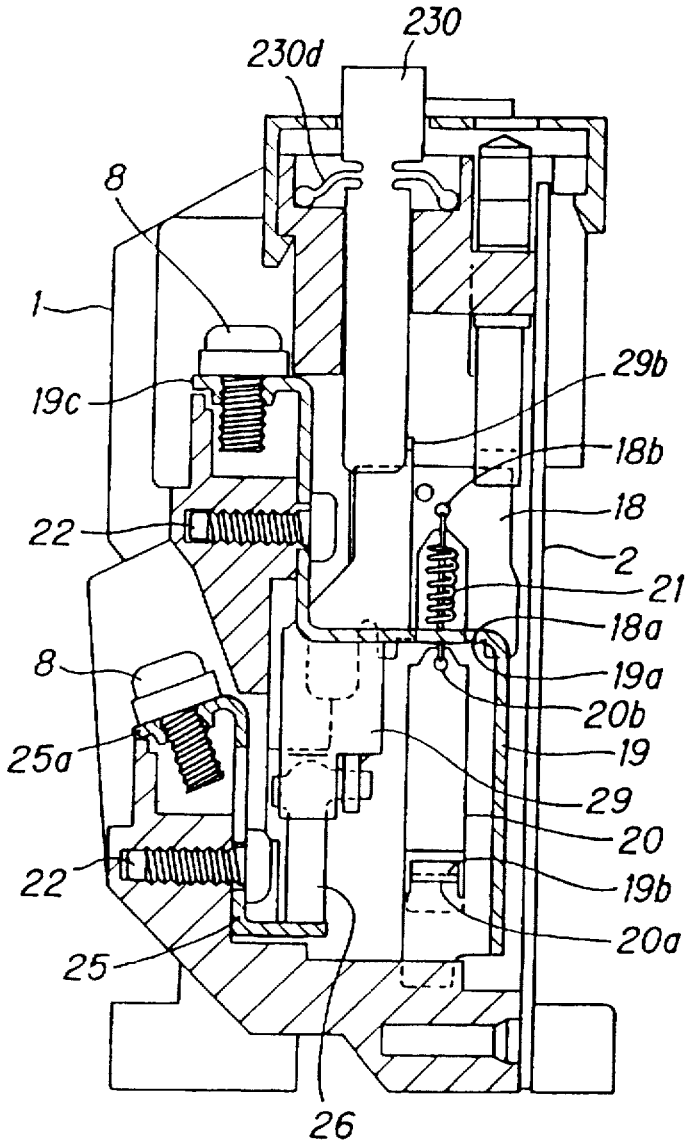
FIG. 12 is a sectional view showing a further overcurrent relay embodiment.
Figure 13:
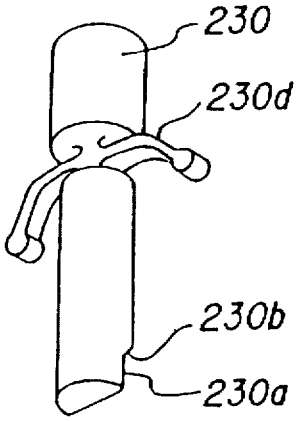
FIG. 13 is a view showing the resetting bar shown in FIG. 12.

A fourth embodiment of the invention will now be described with reference to FIGS. 12 and 13. In this instance, the leaf spring shown before in the third embodiment is assembled such that it is integral with the resetting bar 230. Designated at 230*d* is the leaf spring substitute.

Figure 14:
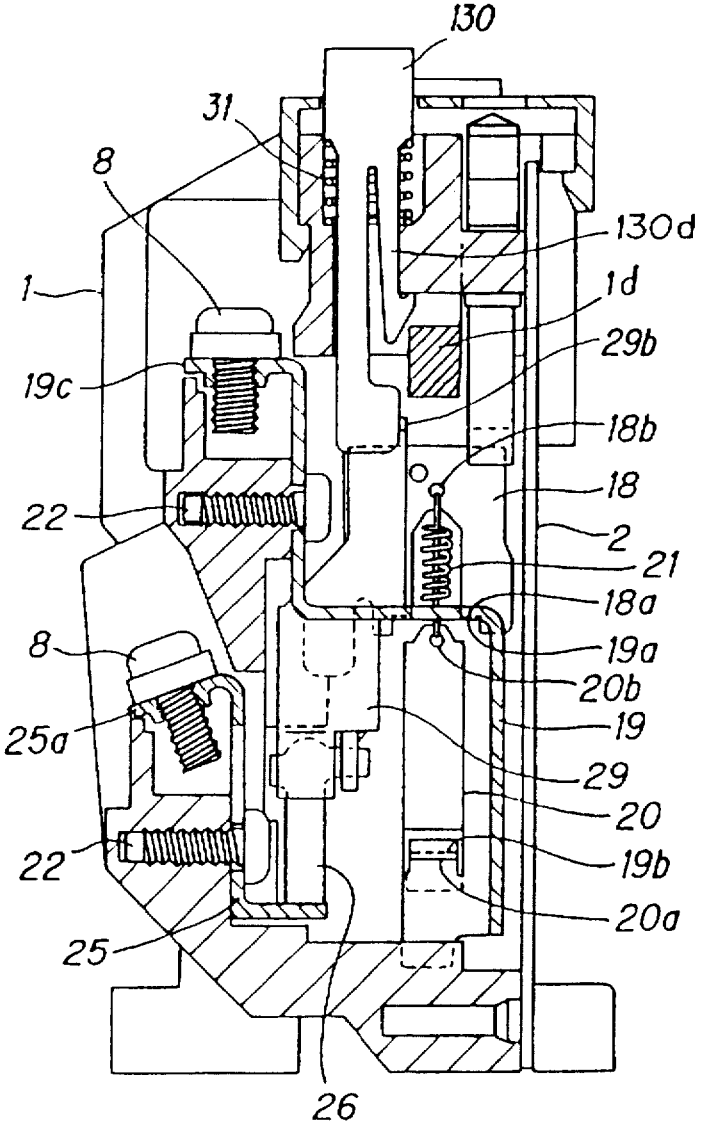
FIG. 14 is a sectional view showing a further overcurrent relay embodiment according to the invention.

A fifth embodiment of the invention will now be described with reference to FIG. 14. Referring to the Figure, a resetting bar 130 is provided with an elastically deformable portion 130*d*, a free end of which can strike the projection 1*d* of the housing 1 while the resetting bar 130 is pushed. By further pushing the bar against the frictional forces, the elastically deformable portion 130*d* is caused to warp to the left, thus causing quick lowering of the resetting bar 130.

Figure 15:
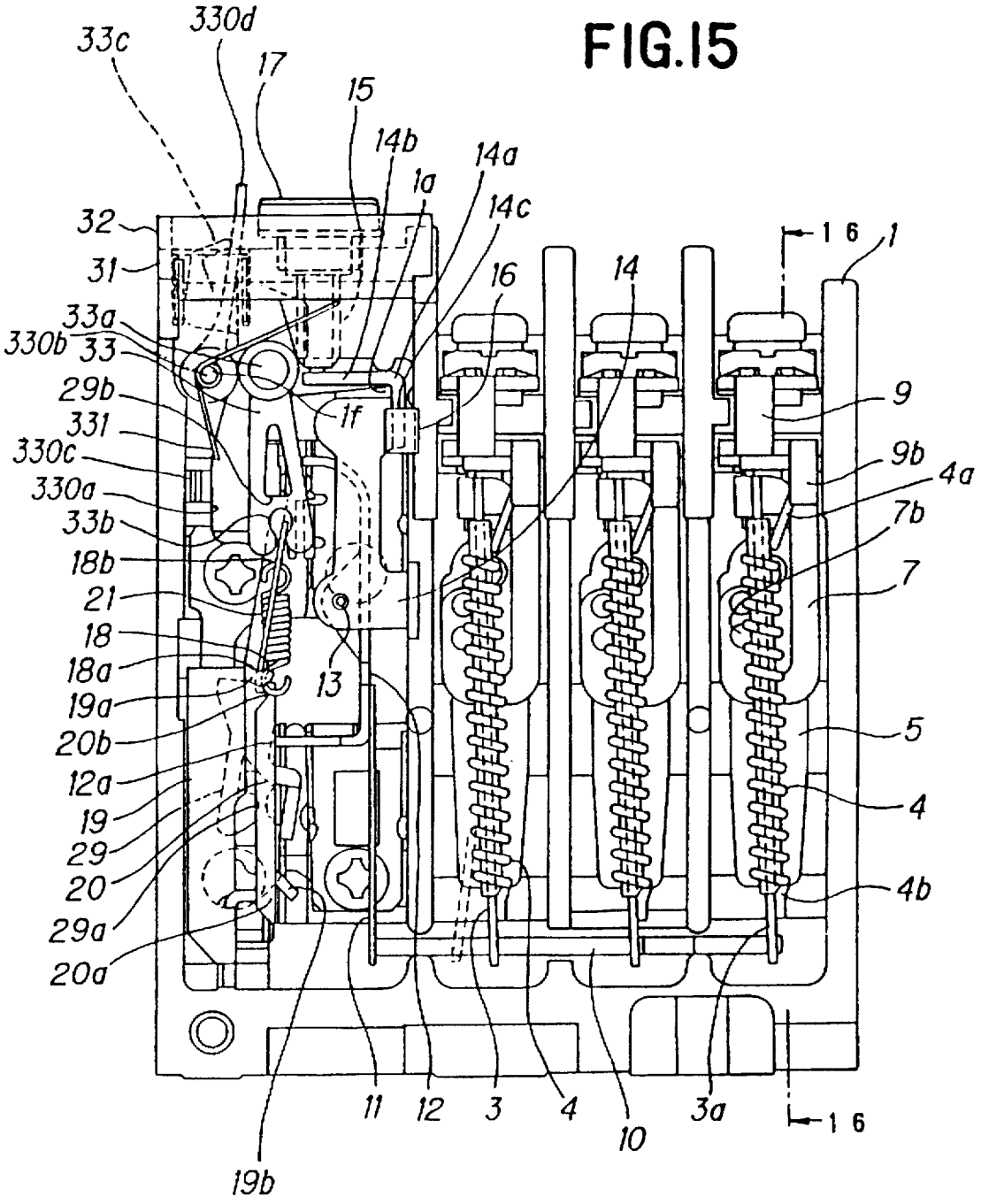
FIG. 15 is a front view showing a further overcurrent relay embodiment according to the invention with a cover removed.
Figure 16:
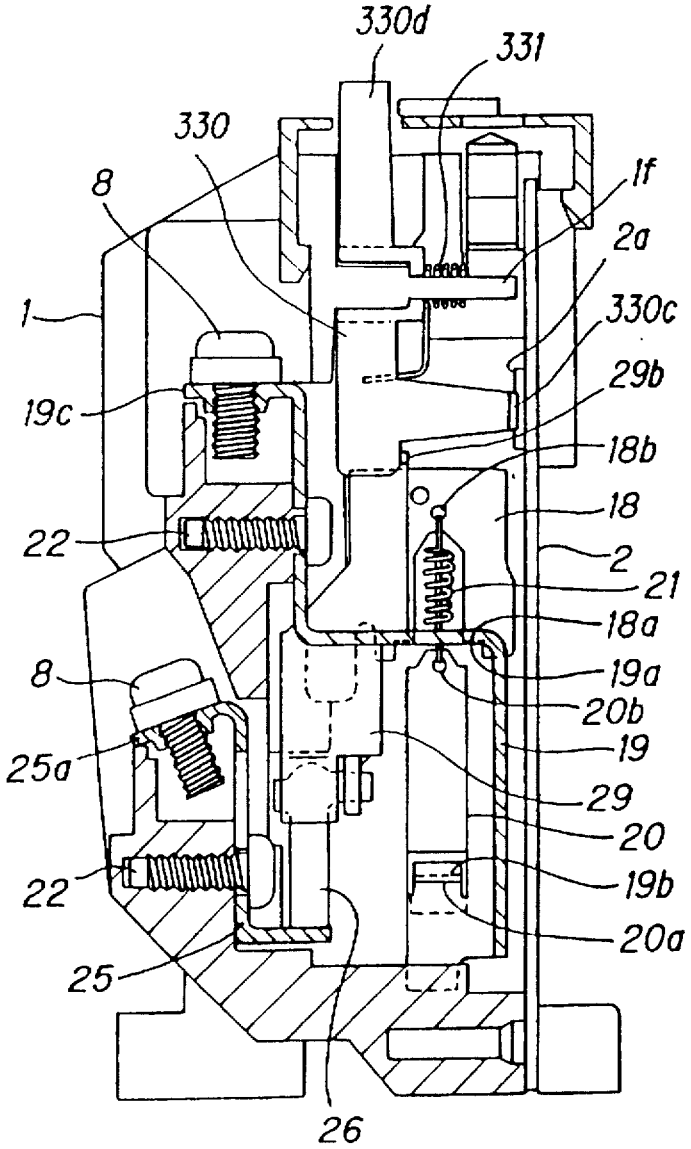
FIG. 16 is a sectional view taken along line 16—16 in FIG. 15.
Figure 17:
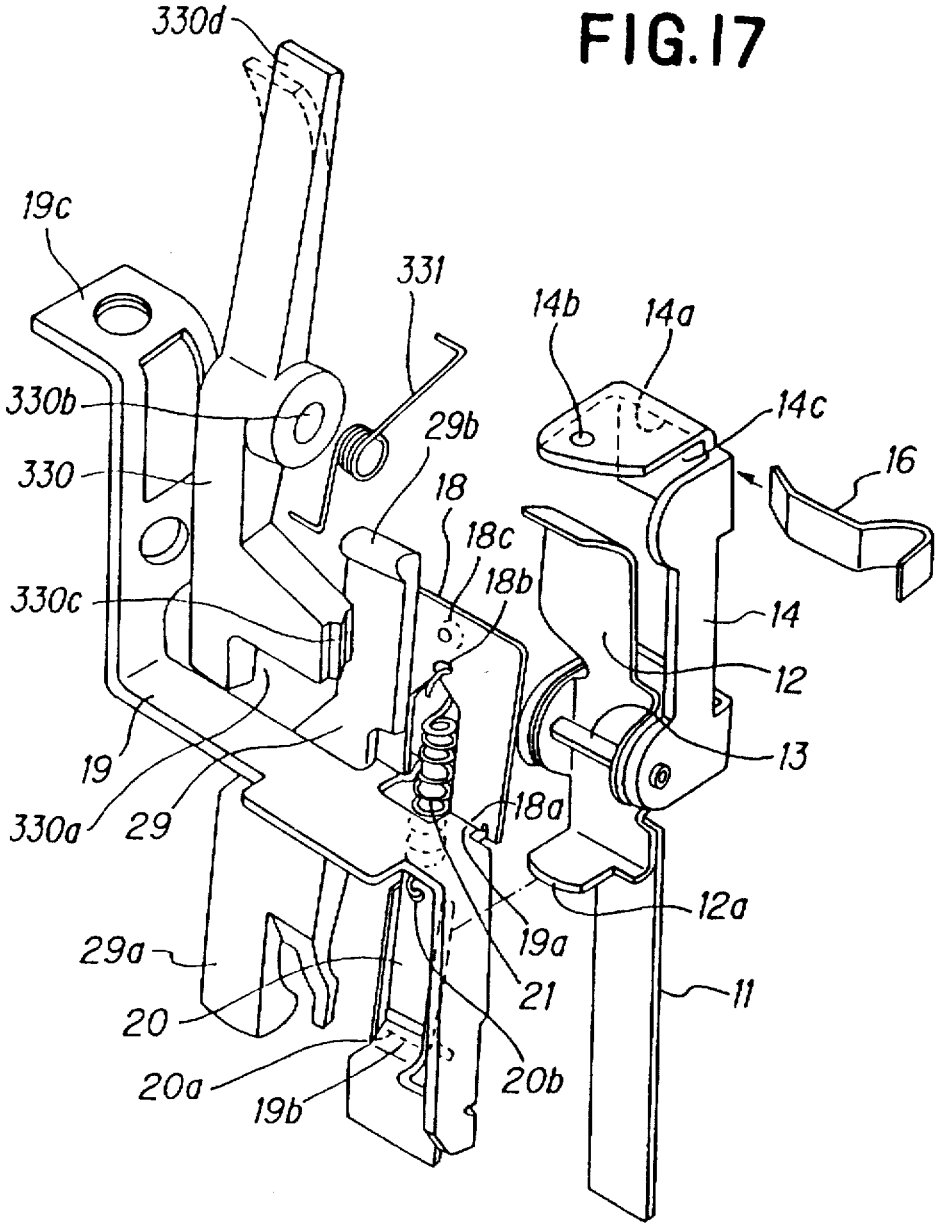
FIG. 17 is an exploded perspective view showing the overcurrent relay shown in FIG. 15.
Figure 18:
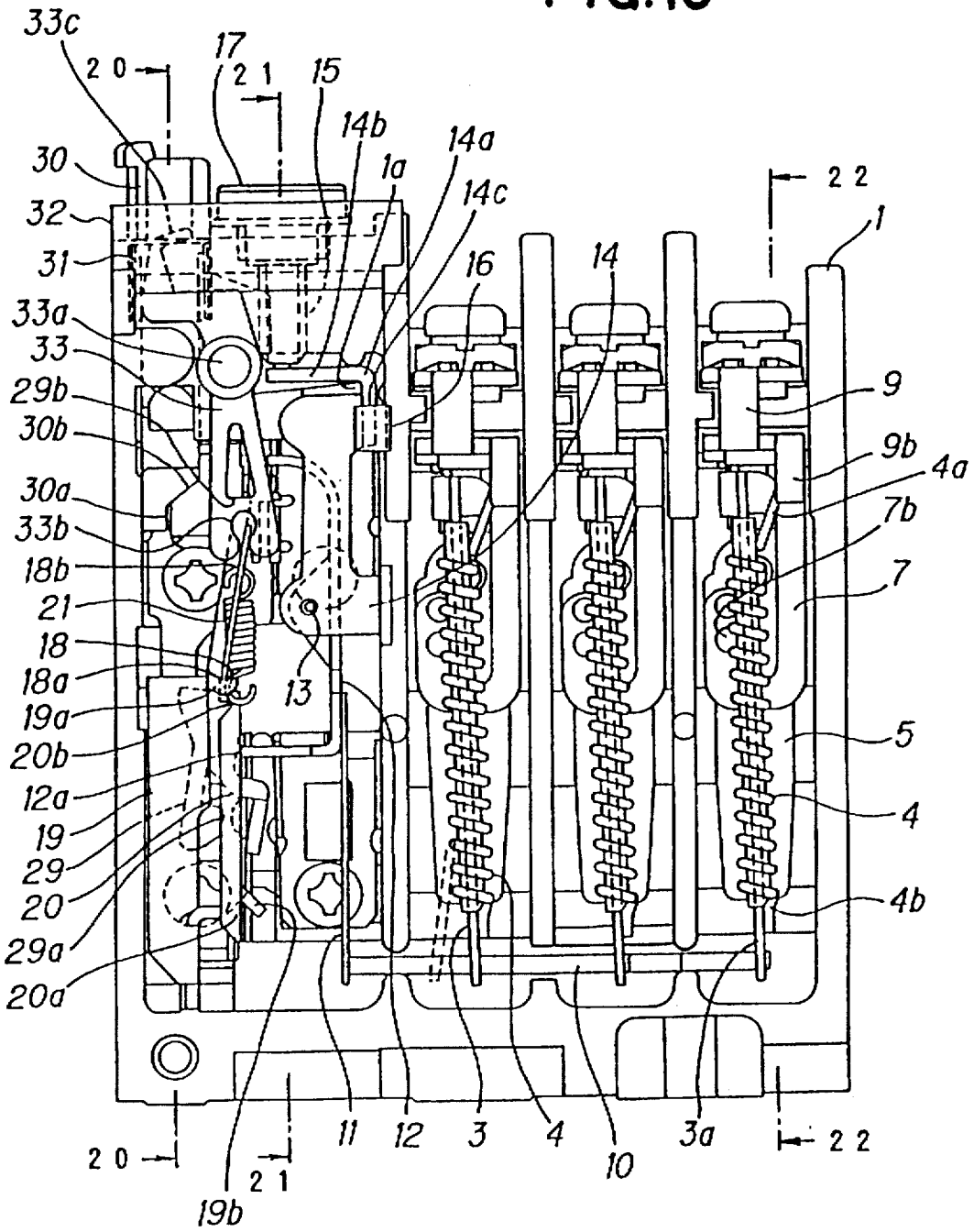
FIG. 18 is a front view showing a conventional overcurrent relay with a cover removed.
Figure 19:
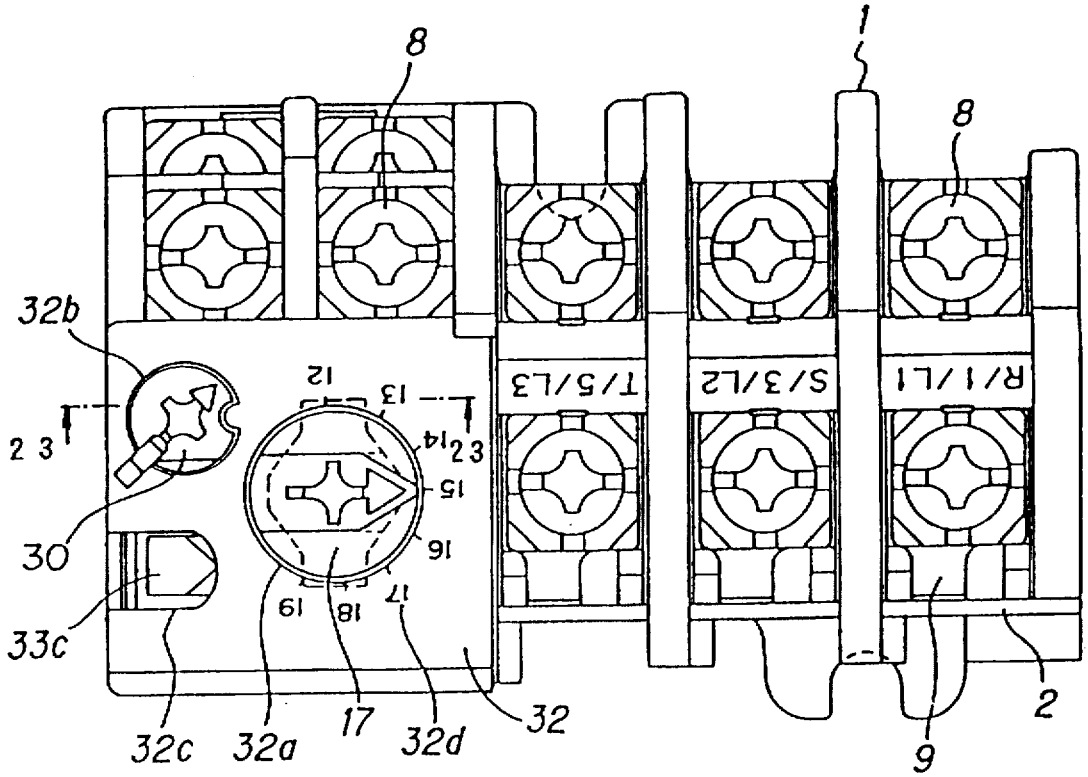
PRIOR ART FIG.19
FIG. 19 is a plan view showing the conventional overcurrent relay.
Figure 20:
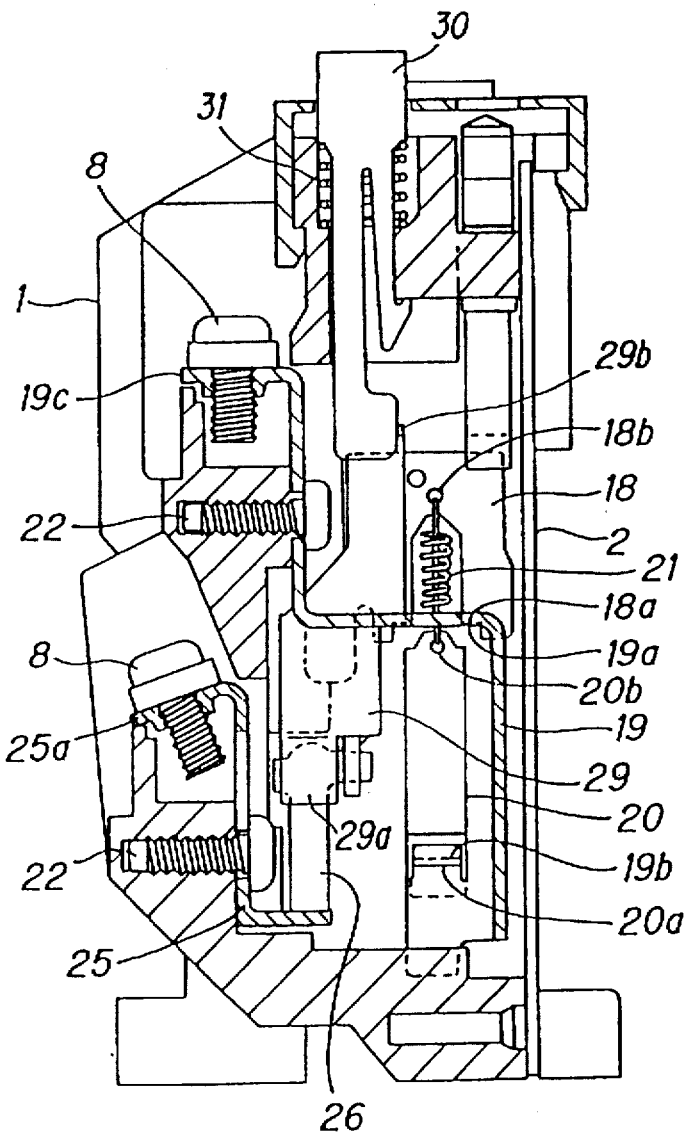
PRIOR ART FIG.20
FIG. 20 is a sectional view taken along line 20—20 in FIG. 18.
Figure 21:
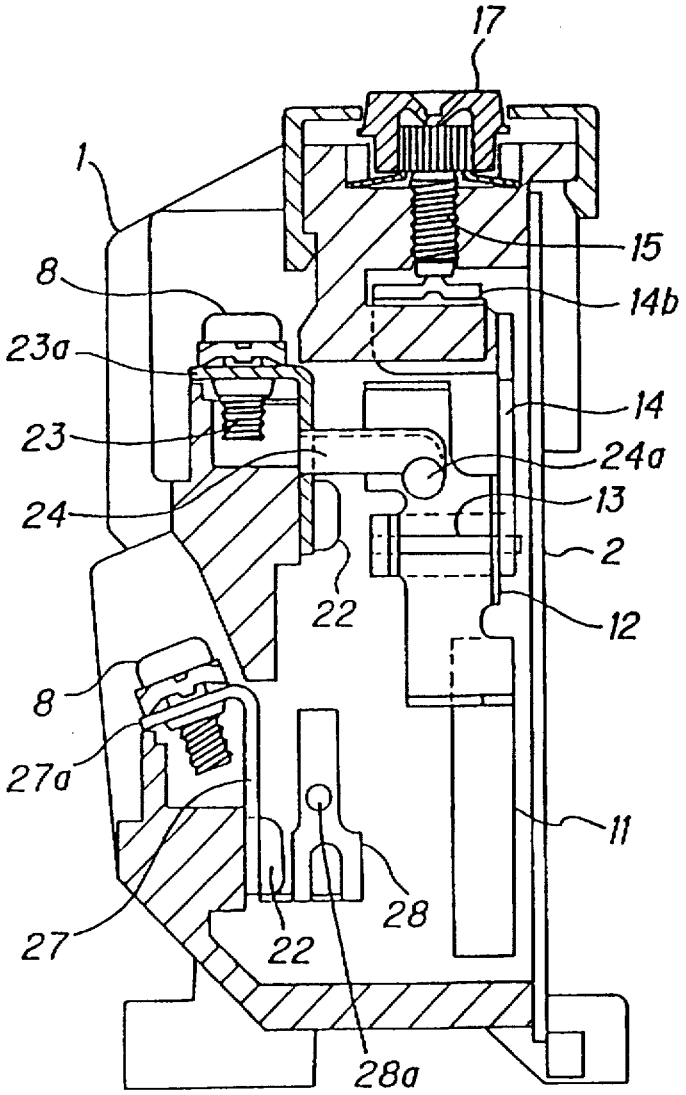
PRIOR ART FIG. 21
FIG. 21 is a sectional view taken along line 21—21 in FIG. 18.
Figure 22:
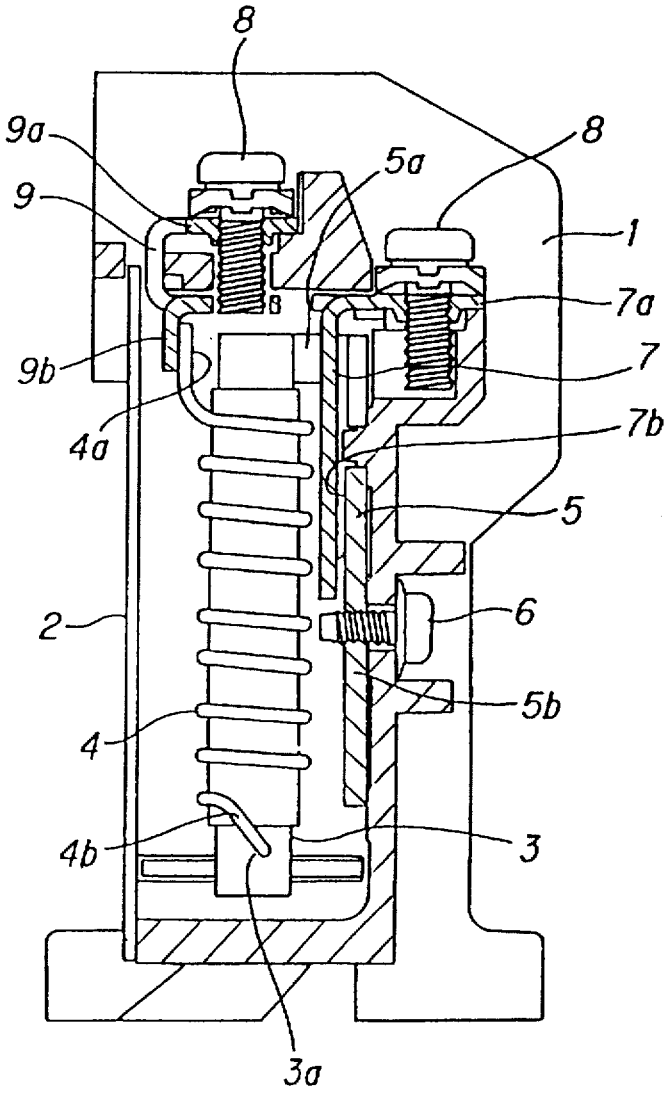
PRIOR ART FIG.22
FIG. 22 is a sectional view taken along line 22—22 in FIG. 18.
Figure 23:
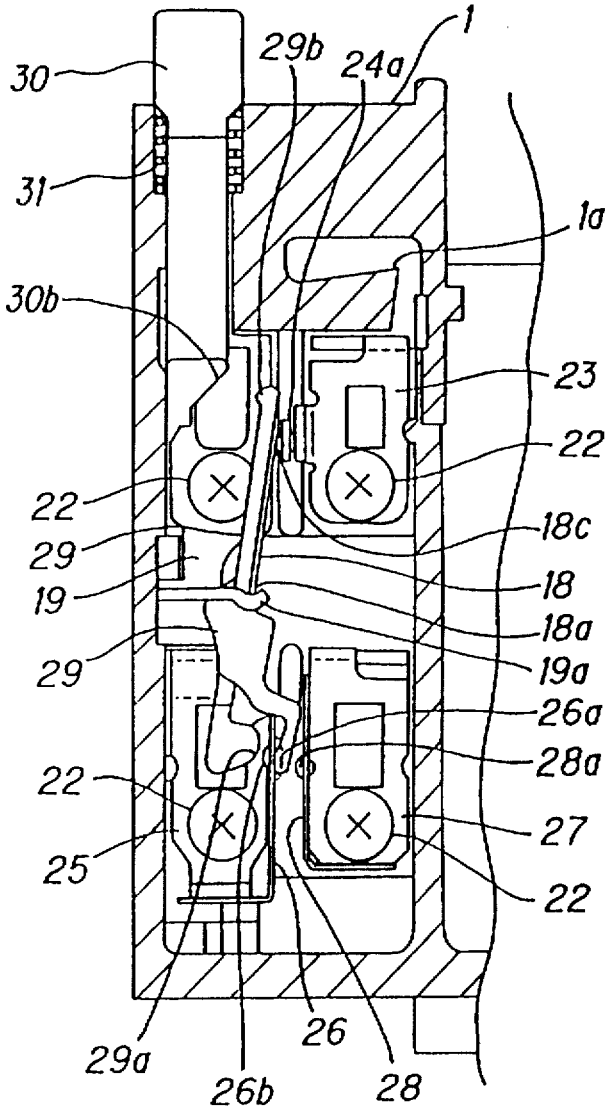
PRIOR ART FIG.23
FIG. 23 is a sectional view taken along line 23—23 in FIG. 19.
Figure 24:
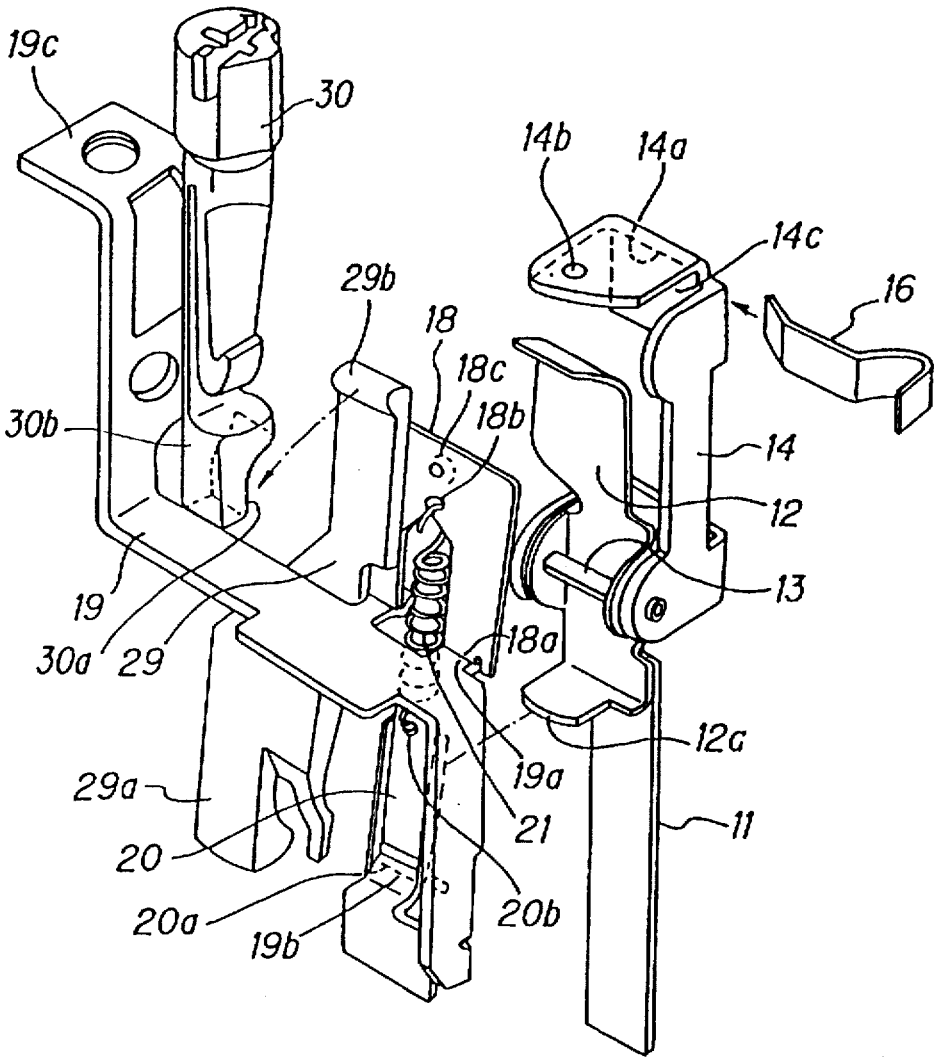
PRIOR ART FIG. 24
FIG. 24 is a perspective view showing an essential part of a resetting bar and an inversion mechanism in a conventional overcurrent relay.
Figure 25:
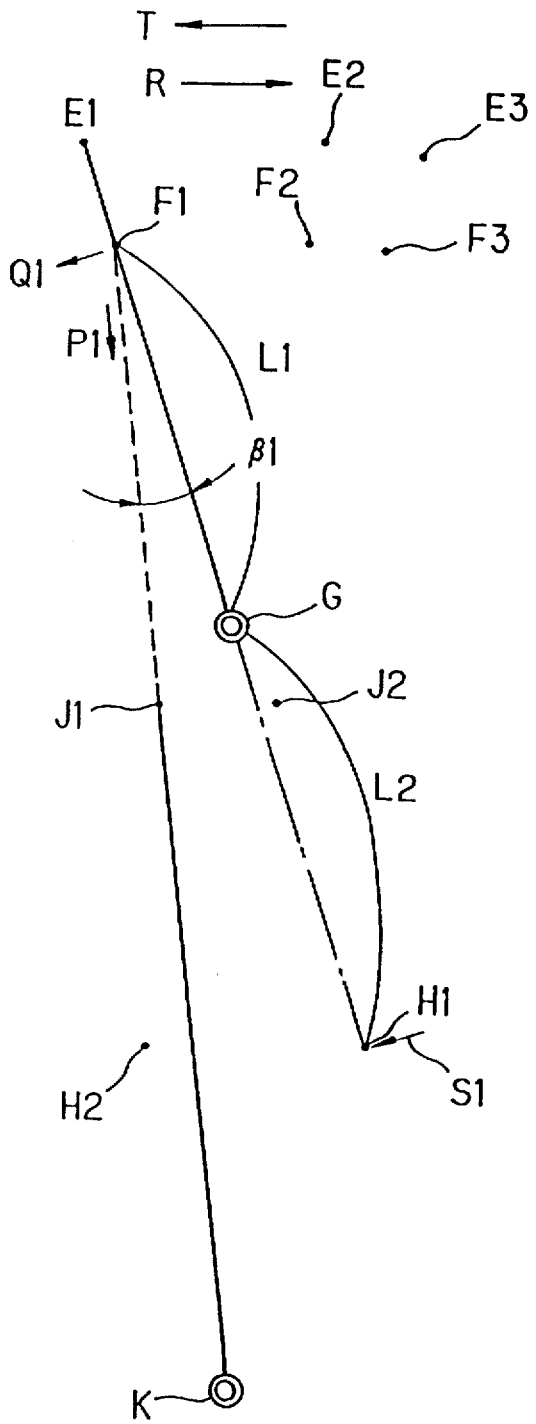
PRIOR ART FIG.25
FIG. 25 is a schematic view showing the inversion mechanism in a trip state thereof.
Figure 26:
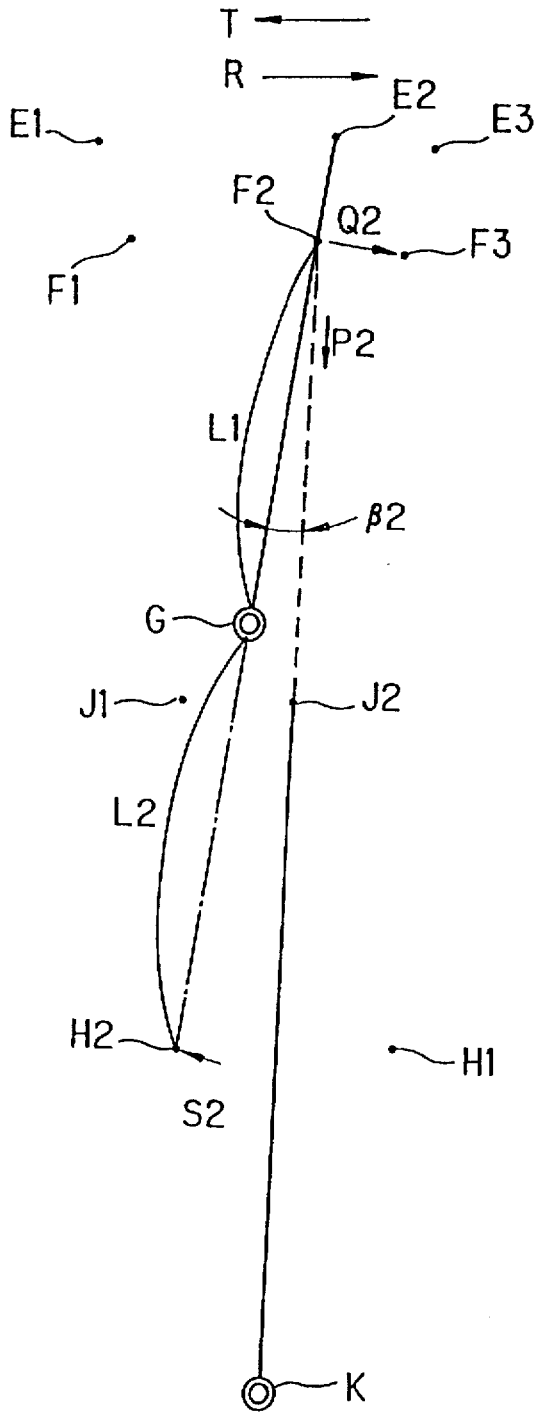
PRIOR ART FIG.26
FIG. 26 is schematic view showing the inversion mechanism during a resetting operation after cooling of bimetals.
Figure 27:
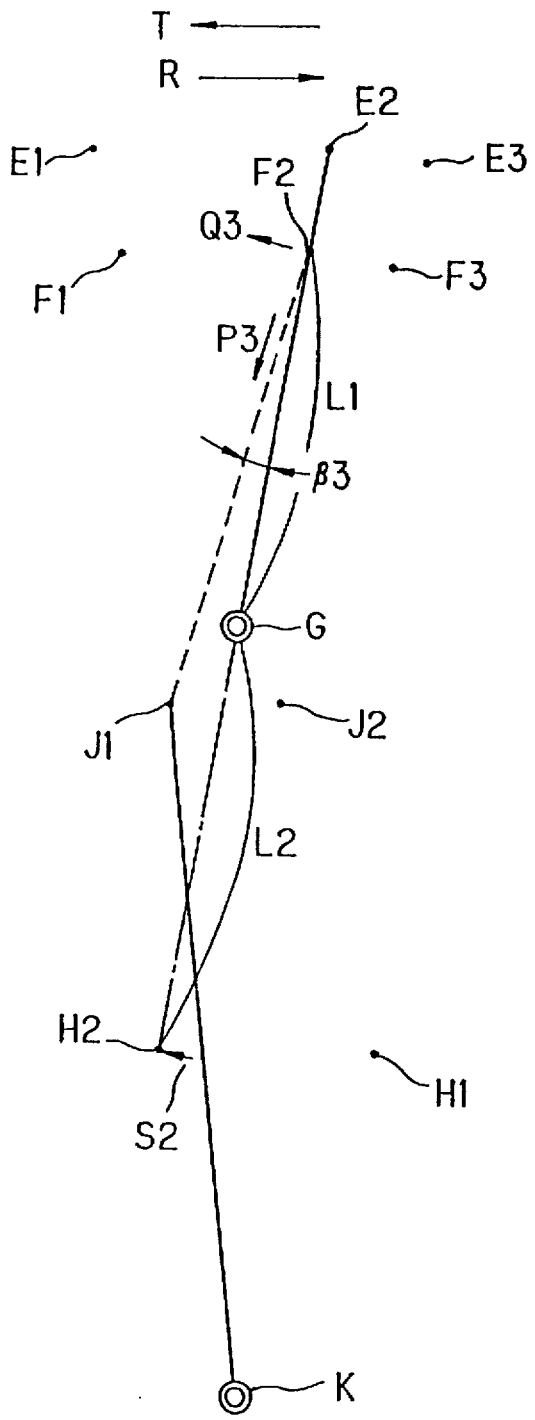
PRIOR ART FIG.27
FIG. 27 is a schematic view showing the inversion mechanism in the resetting operation immediately after the tripping.
Figure 28:
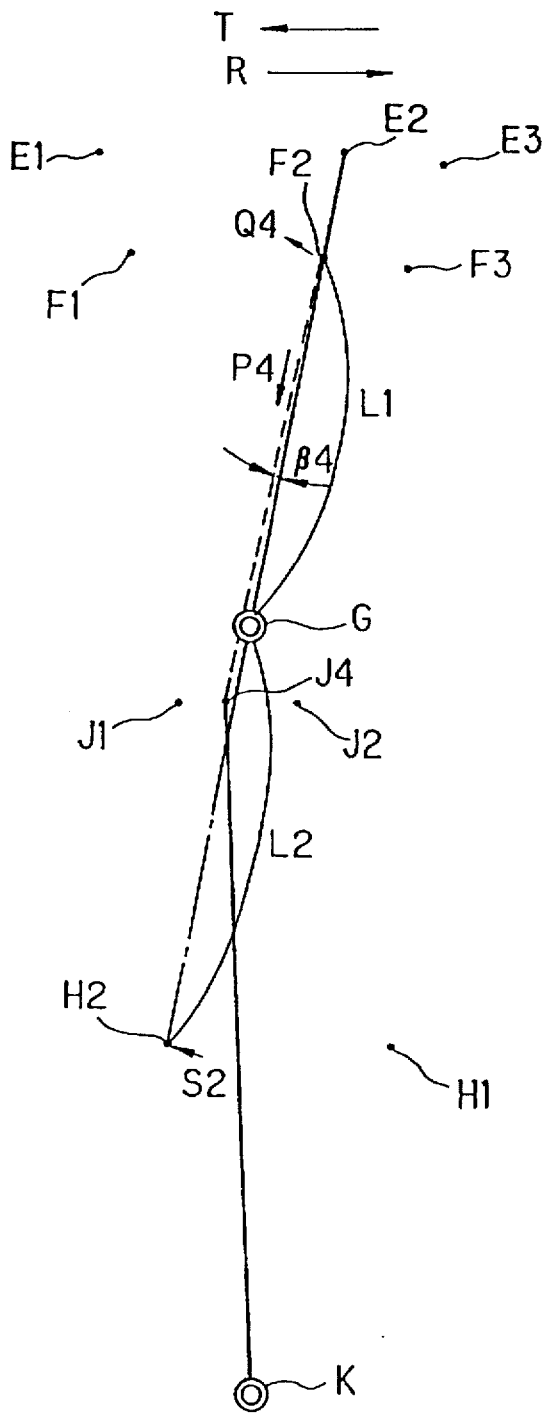
PRIOR ART FIG.28
FIG. 28 is a schematic view showing the inversion mechanism in the resetting operation while the bimetals are being cooled.
Figure 29:
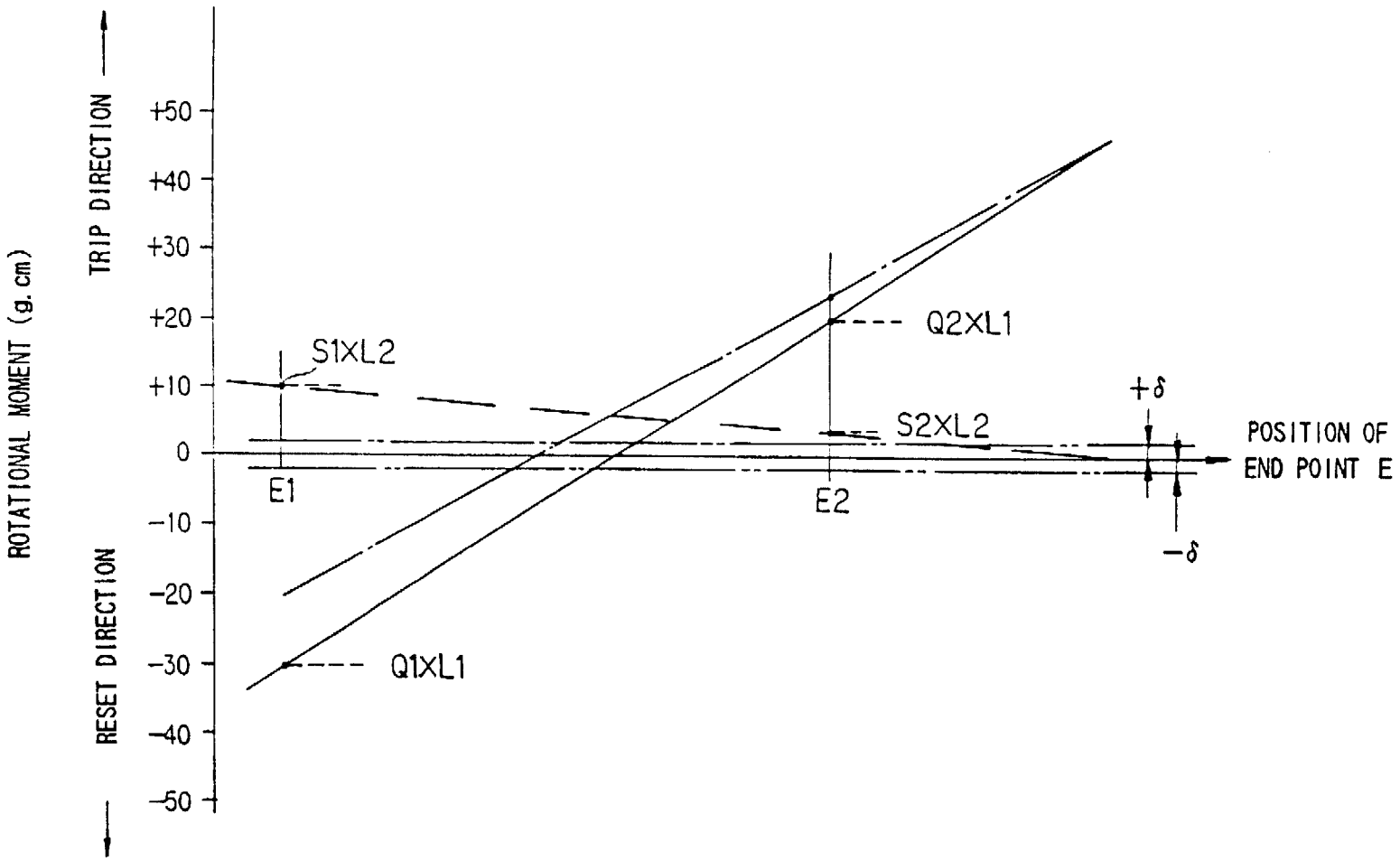
FIG. 29 is a graph concerning the resetting operation after the cooling of the bimetals.
Figure 30:
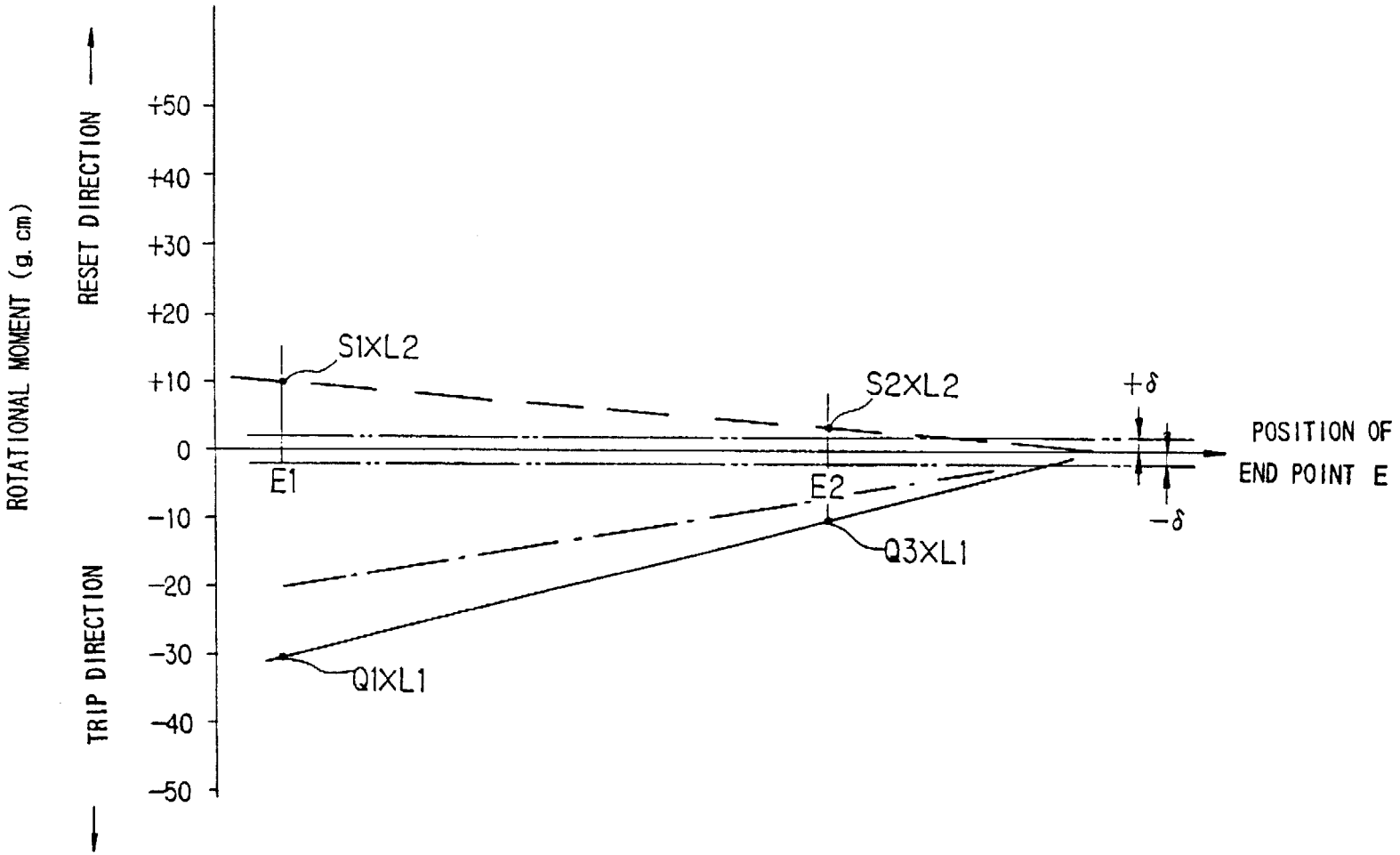
FIG. 30 is a graph concerning the resetting operation immediately after the tripping.
Figure 31:
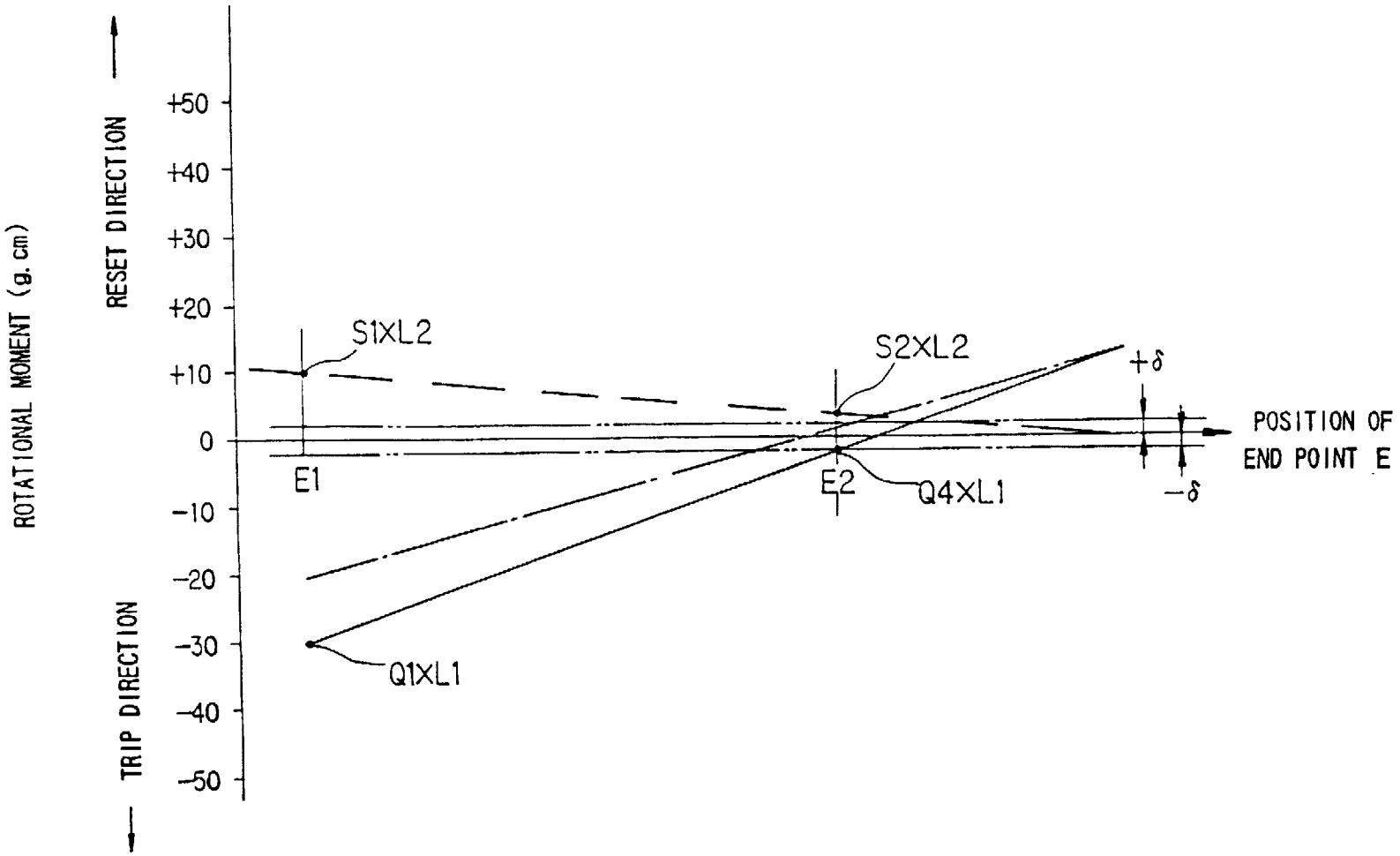
FIG. 31 is a graph concerning the resetting operation during cooling of the bimetals.

A sixth embodiment of the invention will now be described with reference to FIGS. 15 to 17. Referring to the Figures, designated at 330 is a resetting bar having a flat stop surface 330*a*. It has a shaft portion 330*b*, which is rotatably fitted on a shaft 1*f* of the housing 1. Designated at 330*b* is a coil spring biasing the resetting bar 300 in the clockwise direction. With counterclockwise rotation of the resetting bar 330, a protuberance 330*c* thereof is brought into contact with a protuberance 2*a* of the cover (i.e., the protuberance of the guide portion).

For the resetting, a manually operable portion of the resetting bar is operated in the counterclockwise direction. At this time, by continually applying the force to the resetting bar 330 in the counterclockwise direction with the protuberance 330*c* of the resetting bar 330 and the protuberance 2*c* of the cover 2 in engagement with each other, the manually operable portion is caused to warp as shown by dashed lines in FIG. 17. By further applying force, the protuberance 330*c* of the resetting bar 330 clears the protuberance 2*a* of the cover 2 for counterclockwise rotation. At this time, the above deformation causes the force restored by in the manually operable portion is released, thus causing quick rotation of the resetting bar 330.

Although the invention has been described with respect to a specific embodiment for a complete and clear disclosure, the appended claims are not to be thus limited but are to be construed as embodying all modification and alternative constructions that may occur to one skilled in the art which fairly fall within the basic teaching herein set forth.

What is claimed is:

1. an overcurrent relay comprising:

a switch contact means for switchably providing at least one of a first normal electrical connection state and a second electrical connection state;

a bimetal means for providing movement in response to the flow of current therein;

an inverting means for providing a quick inversion movement of said switch connection means between said first connection state and said second connection state;

a linkage mechanism for transmitting said movement of said bimetal means to said inverting means;

operating means for moving in first and second directions interlocked to said movement of said bimetal means via said linkage mechanism and for causing said switch contact to switch between said first connection state and said second connection state;

a resetting member connected for movement of said operating means in said second direction for resetting said switch contact means from said second to said first contact state; and an accelerating mechanism cooperative with said resetting member for accelerating the speed of movement of said switch contact means from said second to said first connection state;

wherein said accelerating mechanism comprises a slant surface formed on said resetting member and a resetting projection formed on said operating means and engageable with said slant surface for increasing the force on said switch contact means, said slant surface having a transient engagement means.

2. An overcurrent relay according to claim 1, wherein said transient engagement means comprises a step.

3. An overcurrent relay according to claim 1 wherein said first normal connection state is at least one of a normally closed and a normally open state, and said second connection state is correspondingly at least one of an open and a closed state.

4. An overcurrent relay according to claim 1 wherein said resetting member is manually operable.

5. An overcurrent relay according to claim 1, wherein said accelerating mechanism further comprises a toggle mechanism coupled to said resetting member.

6. An overcurrent relay according to claim 1 wherein said switch contact means comprises switching contacts and engagement portions connected thereto for engagement with said operating means.

7. An overcurrent relay according to claim 1 wherein said resetting member comprises means for at least one of pushing, pulling or turning said operating means to effect movement of said switch contact means.

8. An overcurrent relay according to claim 1 wherein said resetting member comprises a manually operable section.

9. An overcurrent relay according to claim 1 wherein said first and second directions comprise rotational directions.

10. An overcurrent relay according to claim 1 wherein said first and second directions comprise translational directions.

* * * * *